US011508320B2

(12) United States Patent
Kim et al.

(10) Patent No.: US 11,508,320 B2
(45) Date of Patent: Nov. 22, 2022

(54) PIXEL OF AN ORGANIC LIGHT EMITTING DIODE DISPLAY DEVICE, AND ORGANIC LIGHT EMITTING DIODE DISPLAY DEVICE

(71) Applicant: Samsung Display Co., Ltd., Yongin-Si (KR)

(72) Inventors: Jihye Kim, Hwaseong-si (KR); Jakyoung Jin, Hwaseong-si (KR); Yu-Chol Kim, Jeonju-si (KR); Jin-Wook Yang, Suwon-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/471,217

(22) Filed: Sep. 10, 2021

(65) Prior Publication Data

US 2022/0084472 A1 Mar. 17, 2022

(30) Foreign Application Priority Data

Sep. 11, 2020 (KR) ..... 10-2020-0116816

(51) Int. Cl.

| | |
|---|---|
| ***G09G 3/3291*** | (2016.01) |
| ***G09G 3/3266*** | (2016.01) |
| ***G09G 3/3233*** | (2016.01) |
| ***G09G 3/3208*** | (2016.01) |

(52) U.S. Cl.

CPC ..... *G09G 3/3291* (2013.01); *G09G 3/3266* (2013.01); *G09G 2300/0819* (2013.01); *G09G 2310/061* (2013.01); *G09G 2310/08* (2013.01)

(58) Field of Classification Search

CPC ..... G09G 2320/0233; G09G 2320/0247

See application file for complete search history.

(56) References Cited

U.S. PATENT DOCUMENTS

| | | | | |
|---|---|---|---|---|
| 7,755,585 | B2 * | 7/2010 | Kim | G09G 3/3233 345/76 |
| 10,181,289 | B1 * | 1/2019 | Chen | G09G 3/3233 |
| 10,964,264 | B1 * | 3/2021 | Kim | G09G 3/3266 |
| 2008/0036710 | A1 * | 2/2008 | Kim | G09G 3/3233 345/82 |
| 2011/0157126 | A1 | 6/2011 | Chung et al. | |
| 2011/0227885 | A1 * | 9/2011 | Chung | G09G 3/3233 345/204 |
| 2011/0273428 | A1 * | 11/2011 | Han | G09G 3/3233 345/212 |

(Continued)

*Primary Examiner* — Sepehr Azari

(74) *Attorney, Agent, or Firm* — Innovation Counsel LLP

(57) ABSTRACT

A pixel of an OLED display device includes a first capacitor, a second capacitor, a first transistor configured to generate a driving current, a second transistor configured to transfer a data voltage to a first node, a third transistor configured to diode-connect the first transistor, a fourth transistor configured to transfer an initialization voltage to the second node, a fifth transistor configured to transfer a reference voltage to the first node, a sixth transistor configured to couple a drain of the first transistor and an anode of an organic light emitting diode, a seventh transistor configured to transfer the initialization voltage to the anode of the organic light emitting diode, an eighth transistor configured to transfer the initialization voltage to the drain of the first transistor, and the organic light emitting diode.

19 Claims, 27 Drawing Sheets

(56) References Cited

U.S. PATENT DOCUMENTS

| | | | | |
|---|---|---|---|---|
| 2015/0054722 | A1* | 2/2015 | Kanda | G09G 3/3233 345/77 |
| 2015/0348464 | A1* | 12/2015 | In | G09G 3/2022 345/82 |
| 2020/0226978 | A1* | 7/2020 | Lin | H01L 29/7869 |
| 2021/0065628 | A1* | 3/2021 | Kim | G09G 3/3233 |
| 2021/0193036 | A1* | 6/2021 | Huang | G09G 3/3233 |
| 2021/0248961 | A1 | 8/2021 | Yang et al. | |

* cited by examiner

NORMAL MODE

NORMAL MODE

NORMAL MODE

VARIABLE FREQUENCY MODE

PIXEL OF AN ORGANIC LIGHT EMITTING DIODE DISPLAY DEVICE, AND ORGANIC LIGHT EMITTING DIODE DISPLAY DEVICE

CROSS-REFERENCE TO RELATED APPLICATION(S)

This application claims priority under 35 USC § 119 to Korean Patent Application No. 10-2020-0116816, filed on Sep. 11, 2020, in the Korean Intellectual Property Office (KIPO), the disclosure of which is incorporated by reference herein in its entirety.

BACKGROUND

1. Field

Embodiments of the present inventive concept relate to a display device, and more particularly to a pixel of an organic light emitting diode (OLED) display device, and the OLED display device.

2. Description of the Related Art

In general, an OLED display device may display an image at a fixed frame frequency (or a constant refresh rate) of about 60 Hz, about 120 Hz, about 240 Hz, or the like. However, a frame frequency of a host processor (e.g., a graphic processing unit (GPU) or a graphic card) providing frame data to the OLED display device may be different from the frame frequency of the OLED display device. In particular, when the host processor provides the OLED display device with frame data for a game image (gaming image) that requires complicated rendering, the frame frequency mismatch may be intensified, and a tearing phenomenon where a boundary line is caused by the frame frequency mismatch in an image of the OLED display device may occur.

To prevent or reduce the tearing phenomenon, a variable frequency mode (e.g., a Free-Sync mode, a G-Sync mode, etc.) has been developed in which a host processor provides frame data to an OLED display device at a variable frame frequency by changing a time length (or a duration of time) of a blank period in each frame period. An OLED display device supporting the variable frequency mode may display an image in synchronization with the variable frame frequency, or may drive a display panel at the variable frame frequency or a variable driving frequency, thereby reducing or preventing the tearing phenomenon.

However, in the OLED display device operated at the variable frequency mode, a luminance of the display panel driven at a first driving frequency and a luminance of the display panel driven at a second driving frequency different from the first driving frequency may be different from each other, and thus a flicker may occur when a driving frequency of the display panel is changed.

SUMMARY

Some embodiments provide a pixel of an organic light emitting diode (OLED) display device suitable not only for a normal mode but also for a variable frequency mode.

Some embodiments provide an OLED display device suitable not only for a normal mode but also for a variable frequency mode.

According to embodiments, there is provided a pixel of an OLED display device. The pixel includes a first capacitor coupled between a first power supply voltage line and a first node, a second capacitor coupled between the first node and a second node, a first transistor configured to generate a driving current based on a voltage of the second node, a second transistor configured to transfer a data voltage to the first node in response to a first scan signal, a third transistor configured to diode-connect the first transistor in response to a second scan signal, a fourth transistor configured to transfer an initialization voltage to the second node in response to a third scan signal, a fifth transistor configured to transfer a reference voltage to the first node in response to the second scan signal, a sixth transistor configured to couple a drain of the first transistor and an anode of an organic light emitting diode in response to an emission signal, a seventh transistor configured to transfer the initialization voltage to the anode of the organic light emitting diode in response to a fourth scan signal, an eighth transistor configured to transfer the initialization voltage to the drain of the first transistor in response to a fifth scan signal, and the organic light emitting diode including the anode, and a cathode coupled to a second power supply voltage line.

In embodiments, the eighth transistor may include a gate receiving the fifth scan signal, a source coupled to the drain of the first transistor, and a drain coupled to an initialization voltage line.

In embodiments, the seventh transistor may be turned on to initialize the organic light emitting diode in a normal mode in which a display panel is driven at a fixed frame frequency, and may not be turned on in a variable frequency mode in which the display panel is driven at a variable frame frequency.

In embodiments, the eighth transistor may not be turned on in a normal mode in which a display panel is driven at a fixed frame frequency, and may be turned on to initialize the drain of the first transistor in a variable frequency mode in which the display panel is driven at a variable frame frequency.

In embodiments, each frame period in a normal mode in which a display panel is driven at a fixed frame frequency may include a gate initialization period in which a gate of the first transistor is initialized, a threshold voltage compensation period in which a threshold voltage of the first transistor is compensated, a diode initialization period in which the organic light emitting diode is initialized, a data writing period in which the data voltage is applied to the first node, and an emission period in which the organic light emitting diode emits light, and each frame period in a variable frequency mode in which the display panel is driven at a variable frame frequency may include the gate initialization period, the threshold voltage compensation period, a drain initialization period in which the drain of the first transistor is initialized, the data writing period, and the emission period.

In embodiments, in the drain initialization period, the emission signal may have an off level, the fifth scan signal may have an on level, the first, second, third and fourth scan signals may have the off level, and the eighth transistor may be turned on to apply the initialization voltage to the drain of the first transistor.

In embodiments, a time length of the threshold voltage compensation period may be longer than a time length of the data writing period.

In embodiments, the diode initialization period may overlap the gate initialization period or the threshold voltage compensation period.

In embodiments, the drain initialization period may be located between the data writing period and the emission period.

In embodiments, the second, third, fourth and fifth transistors may be dual transistors.

In embodiments, a first portion of the first through eighth transistors may be implemented with a p-type metal oxide semiconductor (PMOS) transistor, and a second portion of the first through eighth transistors may be implemented with an n-type metal oxide semiconductor (NMOS) transistor.

In embodiments, the initialization voltage transferred by the fourth transistor may be a first initialization voltage, the initialization voltage transferred by the seventh transistor may be a second initialization voltage and the initialization voltage transferred by the eighth transistor may be a third initialization voltage which are different from each other and are transferred through different initialization voltage lines.

In embodiments, the initialization voltage transferred by the seventh transistor may be a second initialization voltage and the initialization voltage transferred by the eighth transistor may be a third initialization voltage which are different from each other and are transferred through different initialization voltage lines.

In embodiments, the initialization voltage transferred by the fourth transistor may be a same voltage as the initialization voltage transferred by the seventh transistor or the initialization voltage transferred by the eighth transistor.

In embodiments, the initialization voltage transferred by the fourth transistor, the initialization voltage transferred by the seventh transistor and the initialization voltage transferred by the eighth transistor may be different from each other and are transferred through different initialization voltage lines.

In embodiments, a signal line transferring the fourth scan signal and a signal line transferring the fifth scan signal may be electrically connected to each other.

In embodiments, each frame period may include a gate initialization period in which a gate of the first transistor is initialized, a threshold voltage compensation period in which a threshold voltage of the first transistor is compensated, a diode and drain initialization period in which the organic light emitting diode and the drain of the first transistor are initialized, a data writing period in which the data voltage is applied to the first node, and an emission period in which the organic light emitting diode emits light.

According to embodiments, there is provided a pixel of an OLED display device. The pixel includes a first capacitor coupled between a first power supply voltage line and a first node, a second capacitor coupled between the first node and a second node, a first transistor configured to generate a driving current based on a voltage of the second node, a second transistor configured to transfer a data voltage to the first node in response to a first scan signal, a fourth transistor configured to transfer a first initialization voltage to the second node in response to a third scan signal, a sixth transistor configured to couple a drain of the first transistor and an anode of an organic light emitting diode in response to an emission signal, an eighth transistor configured to transfer a third initialization voltage to the drain of the first transistor in response to a fifth scan signal, and the organic light emitting diode including the anode and a cathode coupled to a second power supply voltage line.

In embodiments, the pixel may further include a third transistor configured to diode-connect the first transistor in response to a second scan signal, a fifth transistor configured to transfer a reference voltage to the first node in response to the second scan signal, and a seventh transistor configured to transfer a second initialization voltage to the anode of the organic light emitting diode in response to a fourth scan signal;

According to embodiments, there is provided an OLED display device including a display panel including a plurality of pixels, a data driver configured to provide a data voltage to each of the plurality of pixels, a scan driver configured to provide a gate writing signal, a gate initialization signal and a gate drain signal to each of the plurality of pixels, an emission driver configured to provide an emission signal to each of the plurality of pixels, and a controller configured to control the data driver, the scan driver and the emission driver. Each of the plurality of pixels includes a first capacitor coupled between a first power supply voltage line and a first node, a second capacitor coupled between the first node and a second node, a driving transistor configured to generate a driving current based on a voltage of the second node, a switching transistor configured to transfer the data voltage to the first node in response to the gate writing signal, a gate initialization transistor configured to transfer a gate initialization voltage to the second node in response to the gate initialization signal, an emission transistor configured to couple a drain of the driving transistor and an anode of an organic light emitting diode in response to the emission signal, a drain initialization transistor configured to transfer a drain initialization voltage to the drain of the driving transistor in response to the gate drain signal, and the organic light emitting diode including the anode and a cathode coupled to a second power supply voltage line.

According to embodiments, there is provided a pixel of an OLED display device which includes a first capacitor coupled between a first power supply voltage line and a first node, a second capacitor coupled between the first node and a second node, a first transistor coupled between the first power supply voltage line and a third node, a second transistor coupled between a data line and the first node, a third transistor coupled between the second node and the third node, a fourth transistor coupled between the second node and an initialization voltage line, a fifth transistor coupled between the first node and a reference voltage line, a sixth transistor coupled between the third node and an anode of an organic light emitting diode, a seventh transistor coupled between the initialization voltage line and the anode of the organic light emitting diode and an eighth transistor coupled between the initialization voltage line and the third node. The organic light emitting diode may include the anode and a cathode coupled to a second power supply voltage line.

In embodiments, a control electrode of the seventh transistor and a control electrode of the eighth transistor may be coupled to different scan lines which are activated during different time periods, respectively.

In embodiments, a control electrode of the seventh transistor and a control electrode of the eighth transistor may be coupled to a same scan line.

As described above, a pixel of an OLED display device according to embodiments may include a first capacitor coupled between a first power supply voltage line and a first node, a second capacitor coupled between the first node and a second node, a first transistor configured to generate a driving current based on a voltage of the second node, a second transistor configured to transfer a data voltage to the first node in response to a first scan signal, a third transistor configured to diode-connect the first transistor in response to a second scan signal, a fourth transistor configured to transfer a initialization voltage to the second node in response to a third scan signal, a fifth transistor configured to transfer a reference voltage to the first node in response to the second scan signal, a sixth transistor configured to couple a drain of the first transistor and an anode of an organic light emitting diode in response to an emission signal, a seventh transistor configured to transfer the initialization voltage to the anode of the organic light emitting diode in response to a fourth scan signal, an eighth transistor configured to transfer the initialization voltage to the drain of the first transistor in response to a fifth scan signal, and the organic light emitting diode including the anode and a cathode coupled to a line of a second power supply voltage. Accordingly, the pixel may emit light with substantially constant luminance not only in a normal mode but also in a variable frequency mode, and thus may be suitable not only for the normal mode but also for the variable frequency mode.

BRIEF DESCRIPTION OF THE DRAWINGS

Illustrative, non-limiting embodiments will be more clearly understood from the following detailed description in conjunction with the accompanying drawings.

DETAILED DESCRIPTION OF THE EMBODIMENTS

Hereinafter, embodiments of the present inventive concept will be explained in detail with reference to the accompanying drawings.

Figure 1:
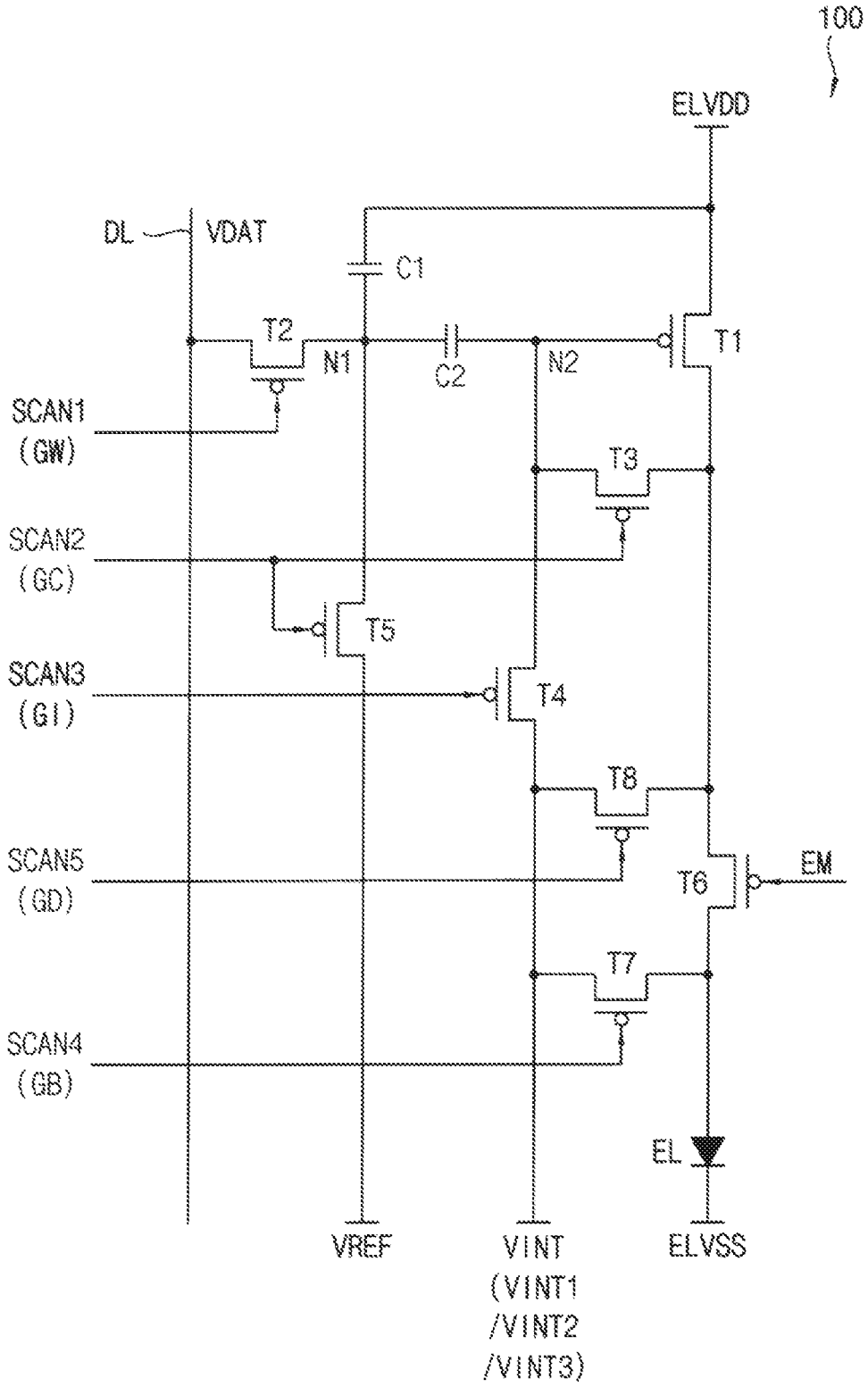
FIG. 1 is a circuit diagram illustrating a pixel of an organic light emitting diode (OLED) display device according to embodiments.
Figure 2:
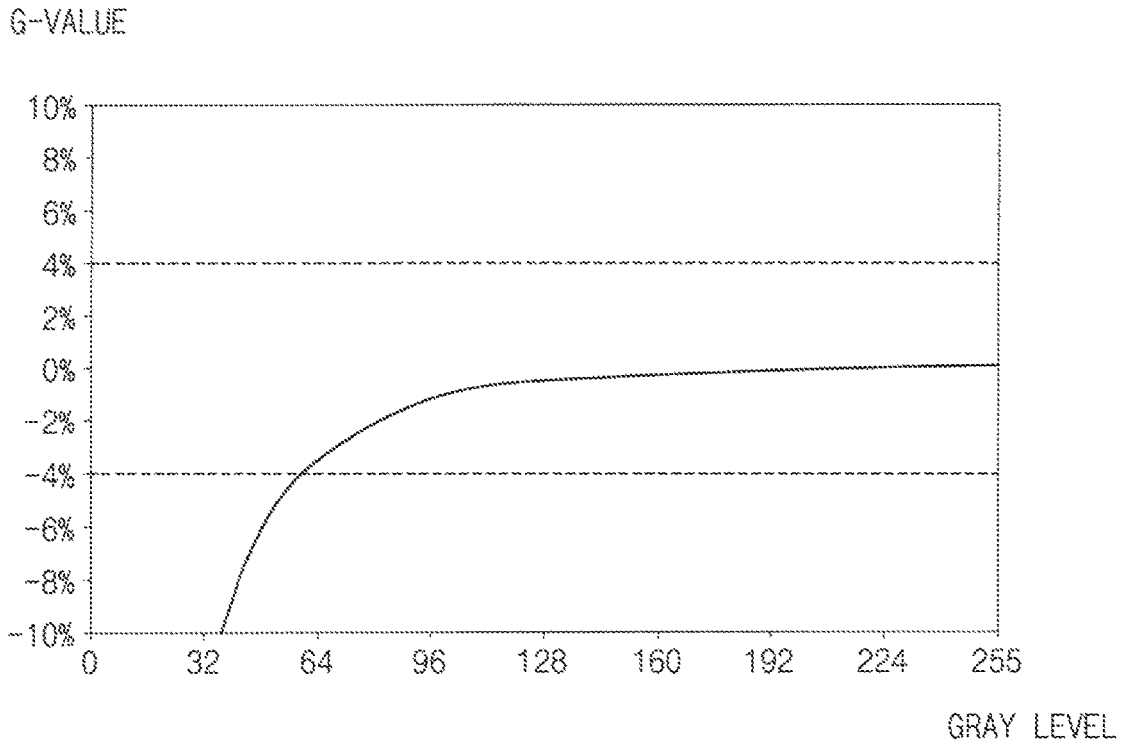
FIG. 2 is a diagram illustrating an example of a G-value of a conventional display panel in which each pixel initializes an OLED in each frame period.
Figure 3:
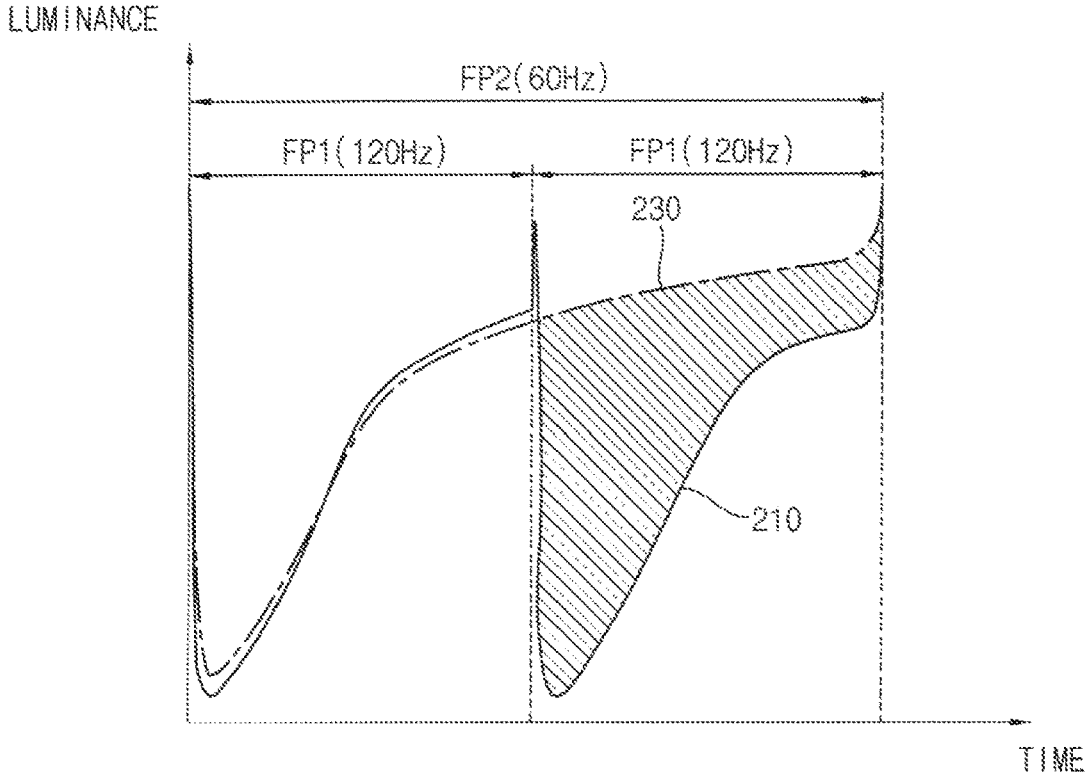
FIG. 3 is a diagram illustrating an example of a luminance of a conventional display panel driven at a frame frequency of about 120 Hz, and an example of a luminance of the conventional display panel driven at a frame frequency of about 60 Hz.
Figure 4:
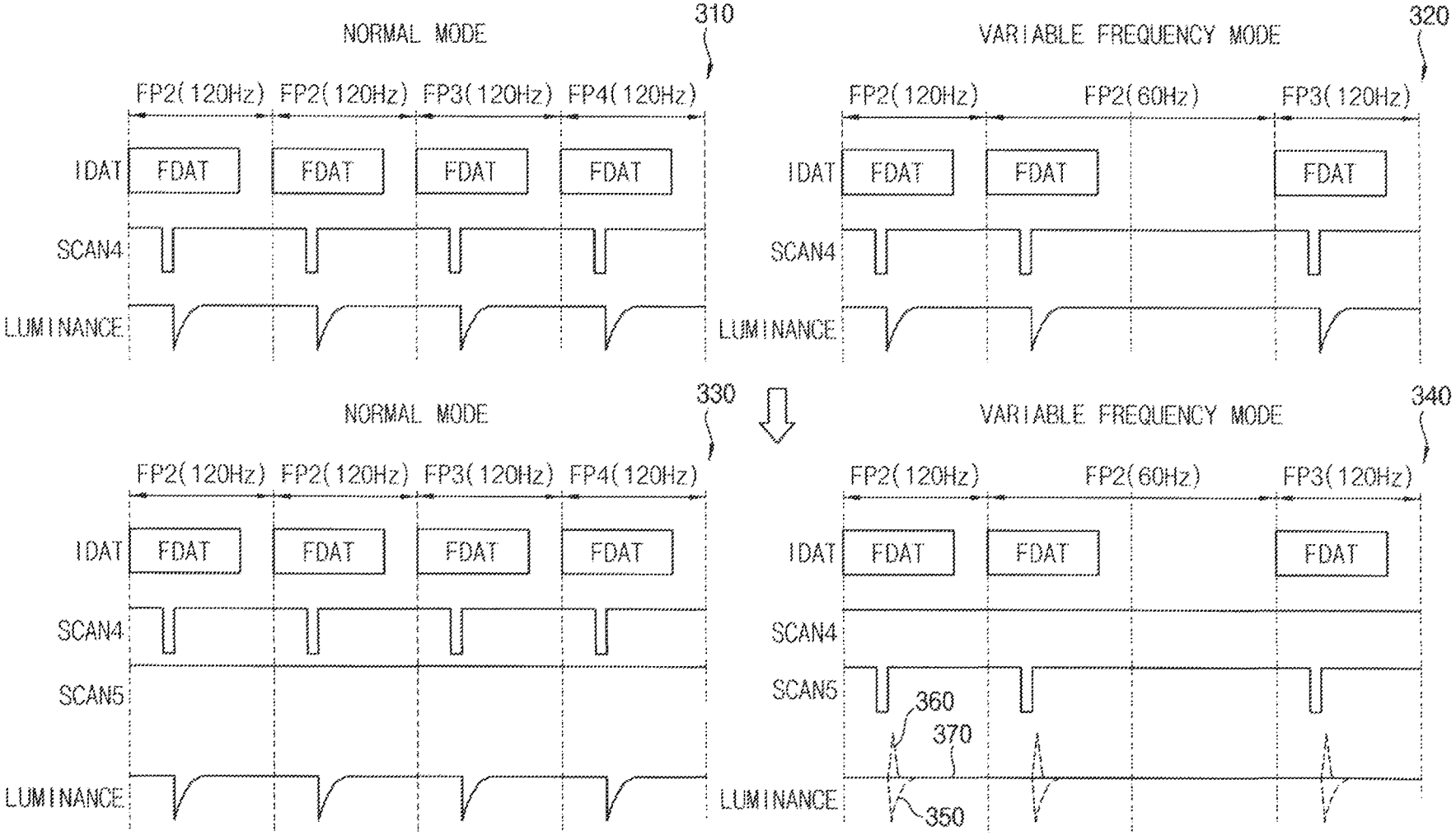
FIG. 4 is a diagram illustrating an example of a luminance of a conventional display panel in a normal mode, an example of a luminance of the conventional display panel in a variable frequency mode, an example of a luminance of a display panel in the normal mode according to embodiments, and an example of a luminance of the display panel in the variable frequency mode according to embodiments.

FIG. 1 is a circuit diagram illustrating a pixel of an organic light emitting diode (OLED) display device according to embodiments, FIG. 2 is a diagram illustrating an example of a G-value of a conventional display panel in which each pixel initializes an OLED in each frame period, FIG. 3 is a diagram illustrating an example of a luminance of a conventional display panel driven at a frame frequency of about 120 Hz, and an example of a luminance of the conventional display panel driven at a frame frequency of about 60 Hz, and FIG. 4 is a diagram illustrating an example of a luminance of a conventional display panel in a normal mode, an example of a luminance of the conventional display panel in a variable frequency mode, an example of a luminance of a display panel in the normal mode according to embodiments, and an example of a luminance of the display panel in the variable frequency mode according to embodiments.

Referring to FIG. 1, a pixel 100 of an OLED display device according to embodiments may include a first capacitor C1, a second capacitor C2, a first transistor T1, a second transistor T2, a third transistor T3, a fourth transistor T4, a fifth transistor T5, a sixth transistor T6, a seventh transistor T7, an eighth transistor T8 and an organic light emitting diode EL.

In some embodiments, as illustrated in FIG. 1, a first initialization voltage VINT1 which is applied to a gate of the first transistor T1 via the fourth transistor T4, a second initialization voltage VINT2 which is applied to an anode of the organic light emitting diode EL via the seventh transistor T7, and a third initialization voltage VINT3 which is applied to a drain of the first transistor T1 via the eighth transistor T8 may be the same initialization voltage VINT provided to the pixel 100 through the same line. Further, in some embodiments, as illustrated in FIG. 1, the first through eighth transistors T1 through T8 may be implemented with, but not limited to, p-type metal oxide semiconductor (PMOS) transistors.

The first capacitor C1 may be coupled between a line of a first power supply voltage ELVDD (e.g., a high power supply voltage) and a first node N1. In some embodiments, the first capacitor C1 may include a first electrode coupled to the line of the first power supply voltage ELVDD, and a second electrode coupled to the first node N1.

The second capacitor C2 may be coupled between the first node N1 and a second node N2. In some embodiments, the second capacitor C2 may include a first electrode coupled to the first node N1, and a second electrode coupled to the second node N2.

The first transistor T1 may generate a driving current based on a voltage of the second node N2, or a voltage of the second electrode of the second capacitor C2. The first transistor T1 may be referred to as a driving transistor. In some embodiments, the first transistor T1 may include a gate coupled to the second node N2, a source coupled to the line of the first power supply voltage ELVDD, and a drain coupled to the third, sixth and eighth transistors T3, T6 and T8.

The second transistor T2 may apply a data voltage VDAT of a data line DL to the first node N1 in response to a first scan signal SCAN1. The second transistor T2 may be referred to as a switching transistor or a scan transistor, and the first scan signal SCAN1 may be referred to as a gate writing signal GW. In some embodiments, the second transistor T2 may include a gate receiving the first scan signal SCAN1, a source coupled to the first node N1, and a drain coupled to the data line DL.

The third transistor T3 may diode-connect the first transistor T1 in response to a second scan signal SCAN2. The third transistor T3 may be referred to as a compensation transistor, and the second scan signal SCAN2 may be referred to as a gate compensation signal GC. In some embodiments, the third transistor T3 may include a gate receiving the second scan signal SCAN2, a source coupled to the drain of the first transistor T1, and a drain coupled to the second node N2.

The fourth transistor T4 may transfer the first initialization voltage VINT1 to the second node N2 in response to a third scan signal SCAN3. The fourth transistor T4 may be referred to as a gate initialization transistor, and the third scan signal SCAN3 may be referred to as a gate initialization signal GI. In some embodiments, the fourth transistor T4 may include a gate receiving the third scan signal SCAN3, a source coupled to the second node N2, and a drain coupled to a line of the first initialization voltage VINT1.

The fifth transistor T5 may apply a reference voltage VREF to the first node N1 in response to the second scan signal SCAN2. The fifth transistor T5 may be referred to as a reference transistor. In some embodiments, the fifth transistor T5 may include a gate receiving the second scan signal SCAN2, a source coupled to a line of the reference voltage VREF, and a drain coupled to the first node N1.

The sixth transistor T6 may couple the drain of the first transistor T1 and an anode of the organic light emitting diode EL in response to an emission signal EM. Thus, the driving current generated by the first transistor T1 may be provided to the organic light emitting diode EL. The sixth transistor T6 may be referred to as an emission transistor. In some embodiments, the sixth transistor T6 may include a gate receiving the emission signal EM, a source coupled to the drain of the first transistor T1, and a drain coupled to the anode of the organic light emitting diode EL.

The seventh transistor T7 may transfer the second initialization voltage VINT2 to the anode of the organic light emitting diode EL in response to a fourth scan signal SCAN4. The seventh transistor T7 may be referred to as a diode initialization transistor, and the fourth scan signal SCAN4 may be referred to as a gate bypass signal GB. In some embodiments, the seventh transistor T7 may include a gate receiving the fourth scan signal SCAN4, a source coupled to the anode of the organic light emitting diode EL, and a drain coupled to a line of the second initialization voltage VINT2.

The eighth transistor T8 may transfer the third initialization voltage VINT3 to the drain of the first transistor T1 in response to a fifth scan signal SCAN5. The eighth transistor T8 may be referred to as a drain initialization transistor, and the fifth scan signal SCAN5 may be referred to as a gate drain signal GD. In some embodiments, the eighth transistor T8 may include a gate receiving the fifth scan signal SCAN5, a source coupled to the drain of the first transistor T1, and a drain coupled to a line of the third initialization voltage VINT3.

The organic light emitting diode EL may emit light based on the driving current generated by the first transistor T1 while the sixth transistor T6 is turned on. In some embodiments, the organic light emitting diode EL may include the anode coupled to the sixth transistor T6 and the seventh transistor T7, and a cathode coupled to a line of a second power supply voltage ELVSS (e.g., a low power supply voltage).

An OLED display device according to embodiments may support not only a normal mode in which a display panel including the pixel 100 is driven at a fixed frame frequency (e.g., about 60 Hz, about 120 Hz, about 240 Hz, or the like), but also a variable frequency mode in which the display panel is driven at a variable frame frequency. For example, the variable frame frequency may have, but not limited to, a range from about 1 Hz to about 120 Hz, a range from about 1 Hz to about 240 Hz, etc.

In the variable frequency mode, even if an image having the same gray level is displayed, a luminance of a conventional display panel in which each pixel 100 initializes an organic light emitting diode EL in each frame period may be changed according to frequencies. FIG. 2 illustrates an example of a G-value of a conventional display panel where a maximum frequency of the variable frame frequency is 120 Hz. In an example of FIG. 2, the G-value may be determined by using an equation, "G-VALUE=(LUM(MAXFREQ)−LUM(MAXFREQ/2))/LUM(MAXFREQ)", where G-VALUE represents the G-value, LUM(MAXFREQ) represents a luminance of the conventional display panel driven at the maximum frequency (e.g., about 120 Hz) of the variable frame frequency, and LUM(MAXFREQ/2) represents a luminance of the conventional display panel driven at a half (e.g., about 60 Hz) of the maximum frequency. In the example of FIG. 2, the G-value of the conventional display panel may have an absolute value lower than about 4% at a gray level greater than about a 60-gray level, but may have an absolute value higher than about 4% at a gray level less than or equal to about the 60-gray level. Thus, in the variable frequency mode, when a low gray image (e.g., lower than the 60-gray level) is displayed, the conventional display panel may have a great luminance difference between different driving frequencies (or different frame frequencies), and a flicker may occur when the driving frequency (or the frame frequency) of the conventional display panel is changed.

As illustrated in FIG. 3, the luminance difference between the different driving frequencies at a low gray level (e.g., a gray level lower than the 60-gray level) may be caused because the number of a luminance valley of the conventional display panel is changed between the different driving frequencies. Herein, the luminance valley means a phenomenon in which pixels emit light lower than targeted luminance during an early stage of one frame. Since the organic light emitting diode EL is initialized or discharged at a start time point of each frame period, the organic light emitting diode EL cannot emit light until a parasitic capacitor of the organic light emitting diode EL is charged, and thus the conventional display panel may have the luminance valley in each frame period. When a high gray image (e.g., higher than the 60-gray level) is displayed, a time period from the start time point of the frame period to a time at which the parasitic capacitor of the organic light emitting diode EL is completely charged may be relatively short because the driving current by the first transistor T1 is relatively high, a luminance of the conventional display panel after the parasitic capacitor of the organic light emitting diode EL is charged may be relatively high, and thus the luminance valley at the start time point of the frame period may not substantially affect an average luminance in the frame period. However, when a low gray image (e.g., lower than the 60-gray level) is displayed, a time period from the start time point of the frame period to the time at which the parasitic capacitor of the organic light emitting diode EL is completely charged may be relatively long because the driving current by the first transistor T1 is relatively low, a luminance of the conventional display panel after the parasitic capacitor of the organic light emitting diode EL is charged may be relatively low, and thus the luminance valley at the start time point of the frame period may affect the average luminance in the frame period. Accordingly, when the low gray image is displayed, in cases where the conventional display panel is driven at the different driving frequencies, the numbers of frame periods during the same time period may be different from each other, the numbers of the luminance valleys during the same time period may be different from each other, and thus average luminance during the same time period may be different from each other.

For example, in an example of FIG. 3 where an image of about a 16-gray level is displayed, during the same time period, the conventional display panel driven at 120 Hz may have two frame period FP1, and the conventional display panel driven at about 60 Hz may have one frame period FP2. Thus, in the conventional display panel, since each pixel 100 initializes the organic light emitting diode EL in each frame period FP1 and FP2, and the parasitic capacitor of the organic light emitting diode EL is discharged in each frame period FP1 and FP2, the organic light emitting diode EL may not emit light until the parasitic capacitor is charged by the driving current generated by the first transistor T1, and the conventional display panel may have the luminance valley in each frame period FP1 and FP2 (see solid line 210). That is, when the low gray image (e.g., a 16-gray image) is displayed, during the same time period, the conventional display panel driven at about 120 Hz may have two luminance valleys, the conventional display panel driven at about 60 Hz may have one luminance valley (see alternated long and short dash line 230), and thus a luminance of the conventional display panel driven at about 60 Hz may be higher than a luminance of the conventional display panel driven at about 120 Hz.

This luminance difference between the different driving frequencies may not cause a flicker in the normal mode in which the conventional display panel is driven at the fixed frame frequency, but may cause the flicker in the variable frequency mode in which the conventional display panel is driven at the variable frame frequency. For example, as illustrated as a diagram 310 in FIG. 4, in the normal mode in which a conventional OLED display device receives, as input image data IDAT, frame data FDAT at the fixed frame frequency (e.g., about 120 Hz), each pixel of the conventional display panel may initialize the organic light emitting diode EL in response to the fourth scan signal SCAN4 (or the gate bypass signal GB) in each frame period FP1, FP2, FP3 and FP4, and the conventional display panel may have one luminance valley in each frame period FP1, FP2, FP3 and FP4 having a constant time length. In this case, the conventional display panel may have a uniform average luminance for a certain time period, and thus the flicker may not occur. However, as illustrated as a diagram 320 in FIG. 4, in the variable frequency mode in which the conventional OLED display device receives, as the input image data IDAT, the frame data FDAT at the variable frame frequency (e.g., about 120 Hz in first and third frame periods FP1 and FP3, and about 60 Hz in a second frame period FP2), by a change of the variable frame frequency, the number of the luminance valley per the certain time period may be changed, an average luminance of the conventional display panel for the certain time period may be changed, and thus the flicker may occur (e.g., between the second frame period FP2 corresponding to about 60 Hz and the third frame period FP3 corresponding to about 120 Hz).

However, in the OLED display device according to embodiments, to prevent or reduce the flicker, the seventh transistor T7 may be turned on to initialize the organic light emitting diode EL in the normal mode, but may not be turned on in the variable frequency mode. Thus, as illustrated as a diagram 330 in FIG. 4, in the normal mode in which the OLED display device according to embodiments receives, as the input image data IDAT, the frame data FDAT at the fixed frame frequency (e.g., about 120 Hz), the pixel 100 according to embodiments may initialize the organic light emitting diode EL in response to the fourth scan signal SCAN4 (or the gate bypass signal GB) in each frame period FP1, FP2, FP3 and FP4 having the fixed time length. However, as illustrated as a diagram 340 in FIG. 4, in the variable frequency mode in which the OLED display device according to embodiments receives, as the input image data IDAT, the frame data FDAT at the variable frame frequency (e.g., about 120 Hz in first and third frame periods FP1 and FP3, and about 60 Hz in a second frame period FP2), the pixel 100 according to embodiments may not receive the fourth scan signal SCAN4, the seventh transistor T7 of the pixel 100 may not be turned on, and the organic light emitting diode EL of the pixel 100 may not be initialized. Accordingly, in the variable frequency mode, the display panel including the pixel 100 according to embodiments may not have the luminance valley 350, and thus the flicker caused by the luminance difference between the different driving frequencies may be prevented or reduced.

However, in a case where the organic light emitting diode EL of the pixel 100 is not initialized, or in a case where the parasitic capacitor of the organic light emitting diode EL is not discharged, the organic light emitting diode EL may momentarily (or instantaneously) emit light in each frame period FP1, FP2 and FP3, and the display panel including the pixel 100 may have a momentary (or instantaneous) luminance peak 360 due to charges remained at the drain of the first transistor T1. However, in the OLED display device according to embodiments, the eighth transistor T8 may not be turned on in the normal mode, but may be turned on to initialize the drain of the first transistor T1 in the variable frequency mode. Thus, as illustrated as the diagram 330 in FIG. 4, in the normal mode, the pixel 100 according to embodiments may not receive the fifth scan signal SCAN5, the eighth transistor T8 of the pixel 100 may not be turned on, and the drain of the first transistor T1 of the pixel 100 may not be initialized. However, as illustrated as the diagram 340 in FIG. 4, in the variable frequency mode, the pixel 100 according to embodiments may initialize the drain of the first transistor T1 in response to the fifth scan signal SCAN5 (or the gate drain signal GD) in each frame period FP1, FP2 and FP3. Thus, the charges remained at the drain of the first transistor T1 may be removed, and the display panel including the pixel 100 may not have the momentary luminance peak 360. Accordingly, the display panel including the pixel 100 according to embodiments have a substantially uniform luminance 370 in the variable frequency mode.

As described above, the pixel 100 according to embodiments may include not only the seventh transistor T7 for the diode initialization (or the anode initialization), but also the eighth transistor T8 for the drain initialization. Further, in the variable frequency mode, the diode initialization by the seventh transistor T7 may not be performed, the drain initialization by the eighth transistor T8 may be performed, and thus the pixel 100 according to embodiments have the substantially uniform luminance (in particular, at the low gray level). Accordingly, the pixel 100 according to embodiments may be suitable not only for the normal mode but also for the variable frequency mode.

Figure 5:
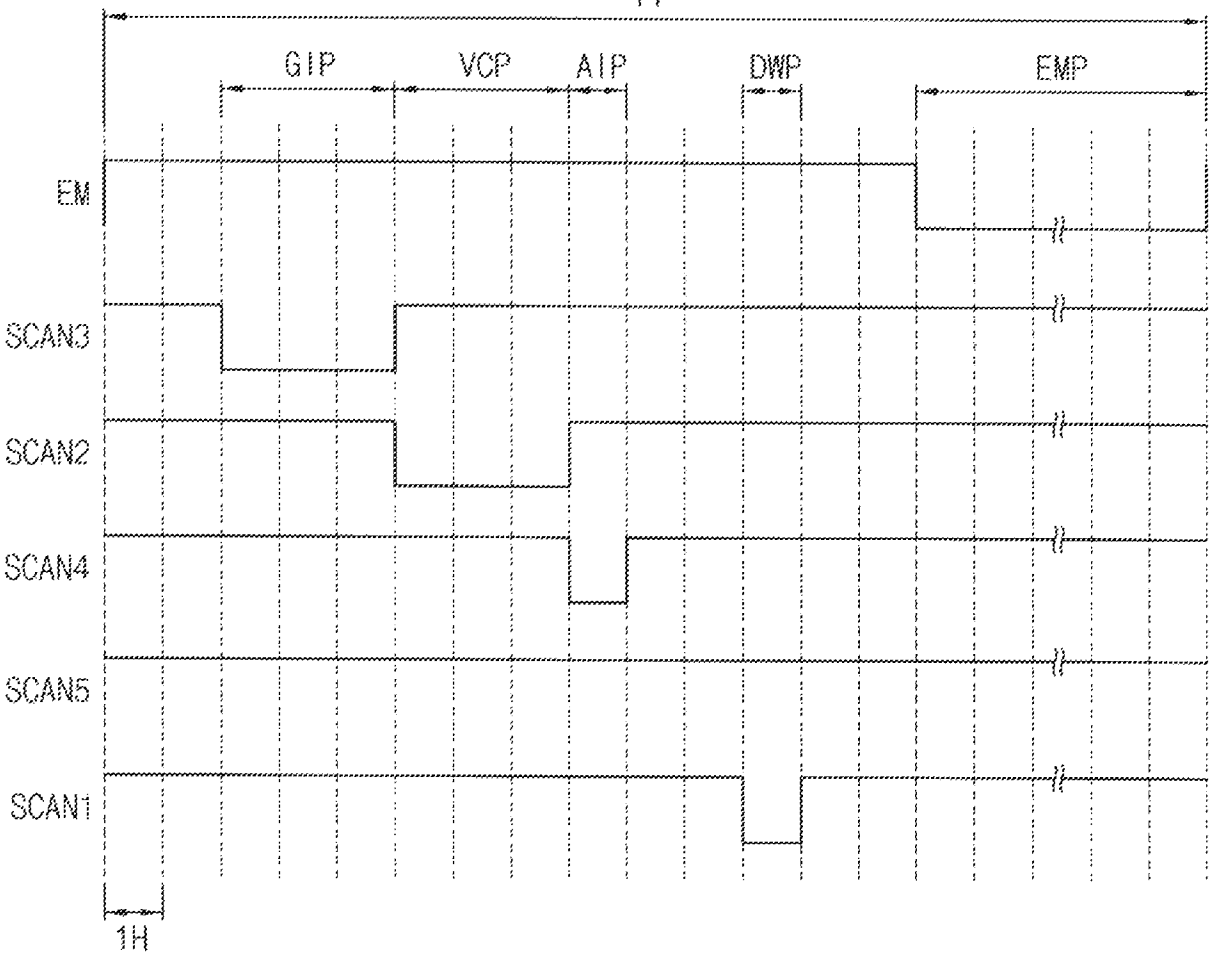
FIG. 5 is a timing diagram for describing an operation of a pixel in a normal mode according to embodiments.
Figure 6:
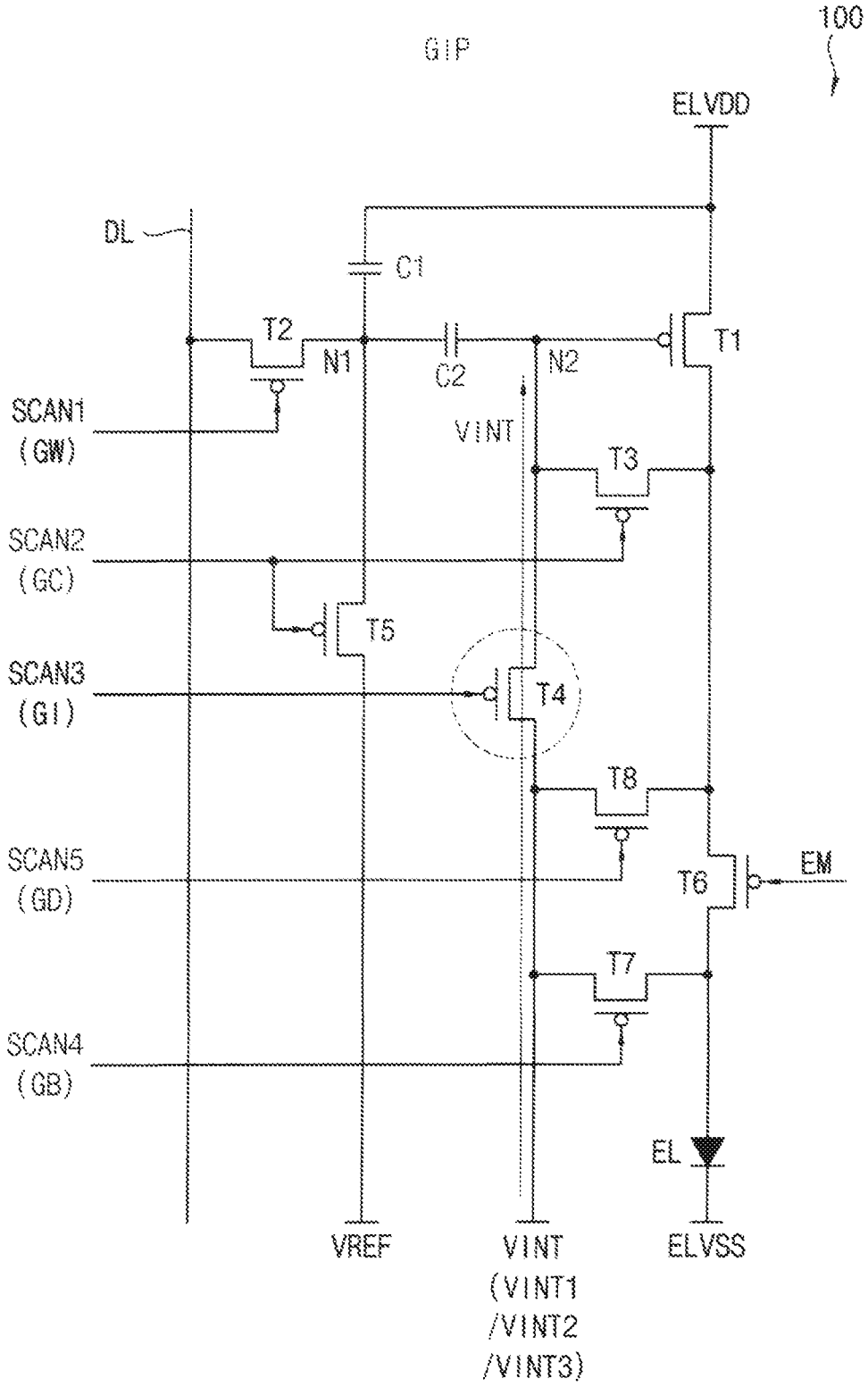
FIG. 6 is a circuit diagram for describing an example of an operation of a pixel in a gate initialization period.
Figure 7:
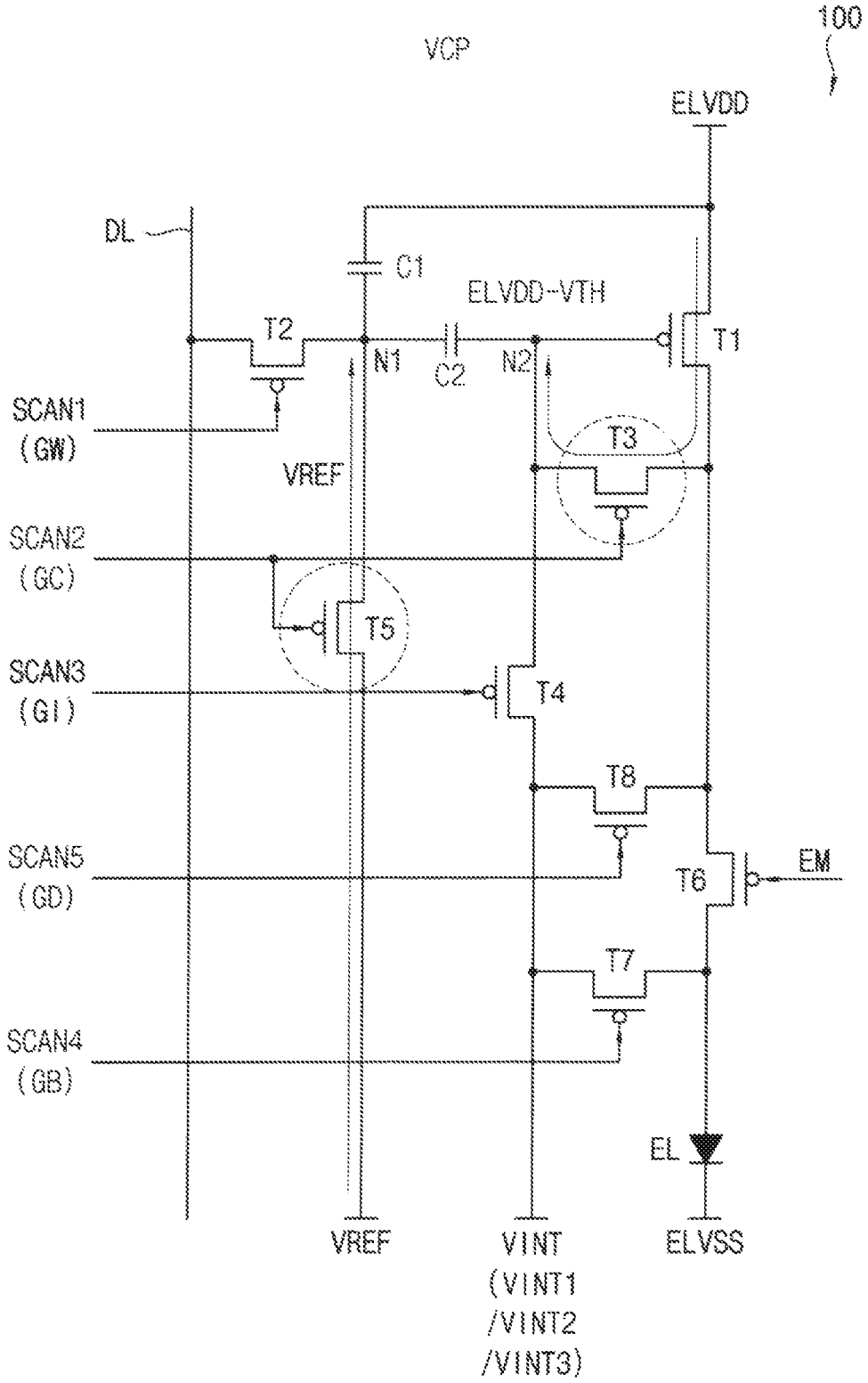
FIG. 7 is a circuit diagram for describing an example of an operation of a pixel in a threshold voltage compensation period.
Figure 8:
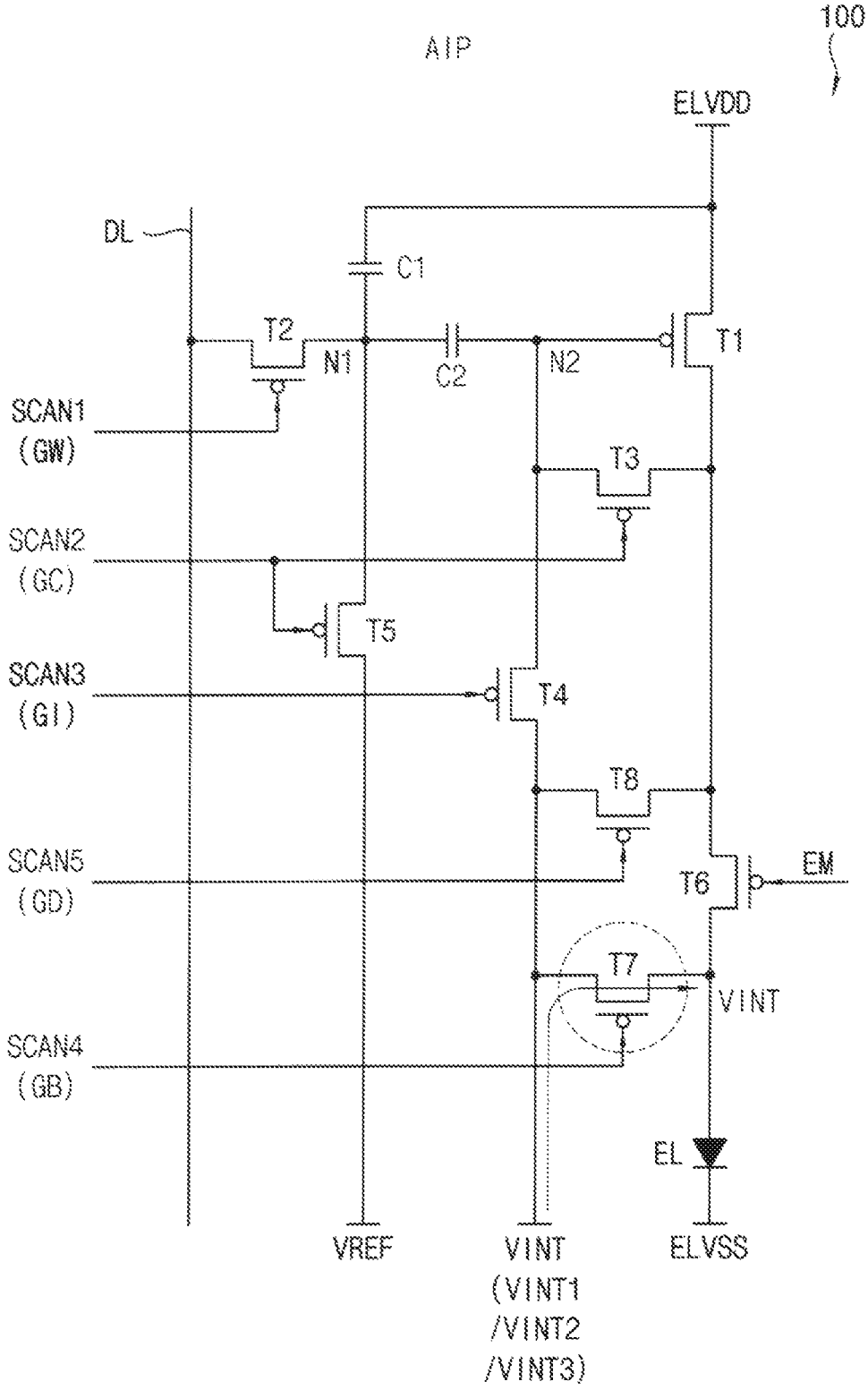
FIG. 8 is a circuit diagram for describing an example of an operation of a pixel in a diode initialization period.
Figure 9:
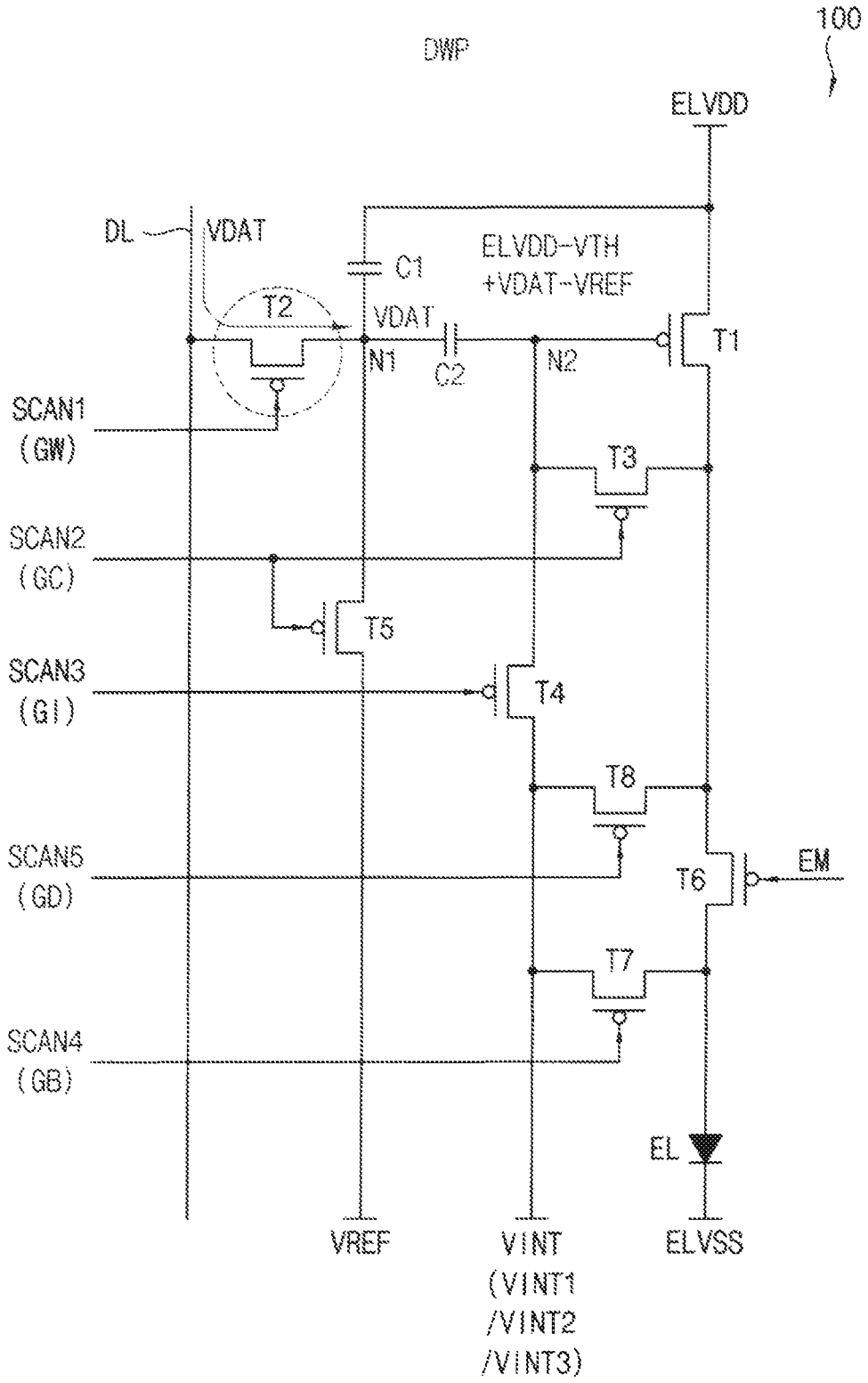
FIG. 9 is a circuit diagram for describing an example of an operation of a pixel in a data writing period.
Figure 10:
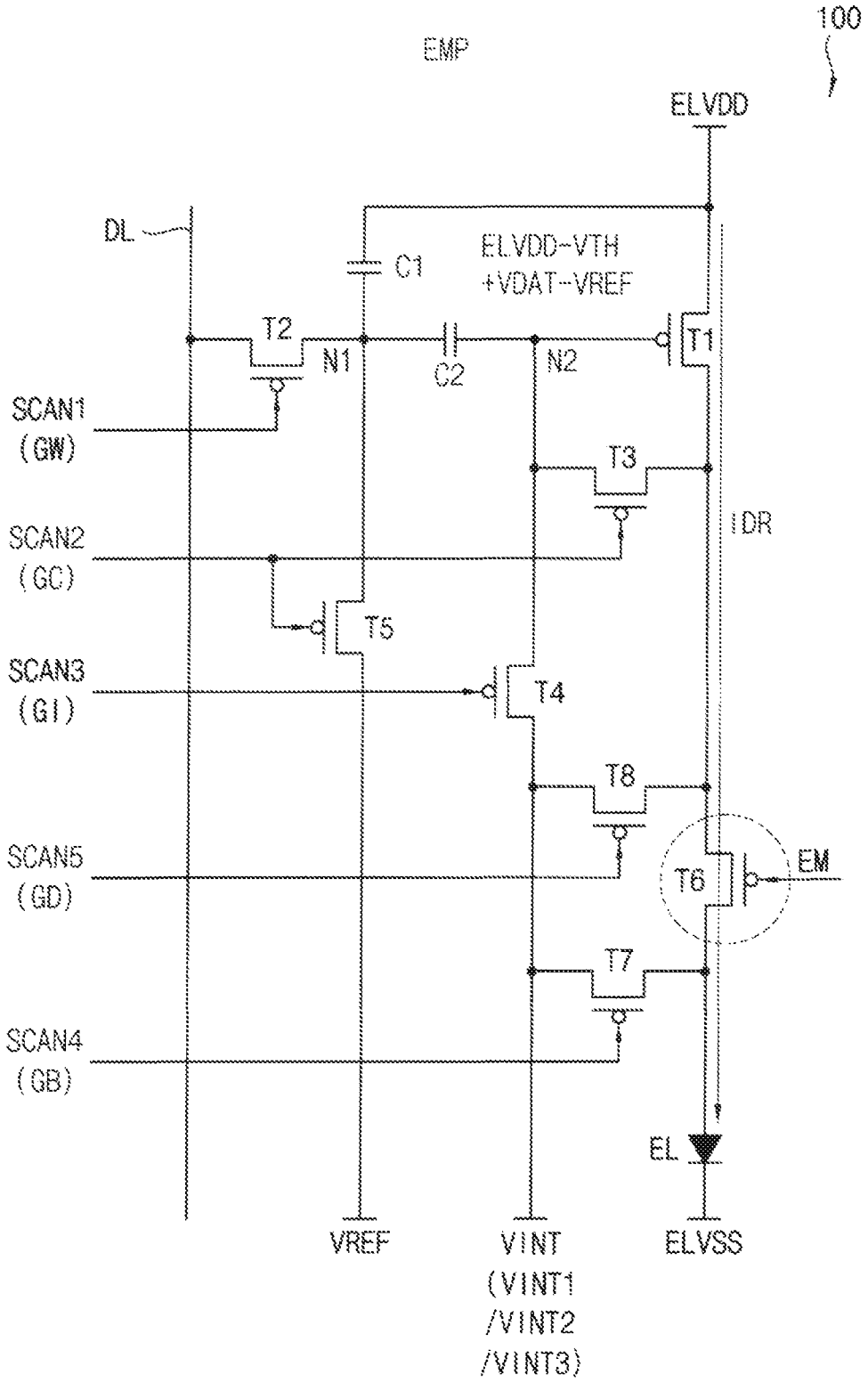
FIG. 10 is a circuit diagram for describing an example of an operation of a pixel in an emission period.

FIG. 5 is a timing diagram for describing an operation of a pixel in a normal mode according to embodiments, FIG. 6 is a circuit diagram for describing an example of an operation of a pixel in a gate initialization period, FIG. 7 is a circuit diagram for describing an example of an operation of a pixel in a threshold voltage compensation period, FIG. 8 is a circuit diagram for describing an example of an operation of a pixel in a diode initialization period, FIG. 9 is a circuit diagram for describing an example of an operation of a pixel in a data writing period, and FIG. 10 is a circuit diagram for describing an example of an operation of a pixel in an emission period.

Referring to FIGS. 1 and 5, each frame period FP in a normal mode in which a display panel is driven at a fixed frame frequency includes a gate initialization period GIP in which a gate of a first transistor T1 is initialized, a threshold voltage compensation period VCP in which a threshold voltage of the first transistor T1 is compensated, a diode initialization period AIP in which an organic light emitting diode EL is initialized, a data writing period DWP in which a data voltage VDAT is applied to a first node N1, and an emission period in which an organic light emitting diode EL emits light. In some embodiments, as illustrated in FIG. 5, first, second, third, fourth and fifth scan signals SCAN1, SCAN2, SCAN3, SCAN4 and SCAN5 and an emission signal EM may be, but not limited to, active low signals having a low level as an on level and a high level as an off level.

In the gate initialization period GIP, the emission signal may have the off level, the third scan signal SCAN3 may have the on level, and the first, second, fourth and fifth scan signals SCAN1, SCAN2, SCAN4 and SCAN5 may have the off level. In the gate initialization period GIP, as illustrated in FIG. 6, a fourth transistor T4 may be turned on in response to the third scan signal SCAN3 having the on level. Thus, the fourth transistor T4 may apply an initialization voltage VINT (or a first initialization voltage VINT1) to a second node N2, or the gate of the first transistor T1, and the gate of the first transistor T1 may be initialized. In some embodiments, a time length of the gate initialization period GIP may correspond to, but not limited to, three horizontal times (or a 3H time). Here, one horizontal time (or a 1H time) may be a time allocated for one row of pixels 100, and one frame period FP may include a plurality of horizontal times of which the number is greater than or equal to the number of pixel rows of the display panel. Further, in some embodiments, the one horizontal time (or the 1H time) of an OLED display device may be determined according to the fixed frame frequency in the normal mode (or a maximum frequency of a variable frame frequency in a variable frequency mode) and the number of pixel rows of the display panel.

In the threshold voltage compensation period VCP, the emission signal may have the off level, the second scan signal SCAN2 may have the on level, and the first, third, fourth and fifth scan signals SCAN1, SCAN3, SCAN4 and SCAN5 may have the off level. In the threshold voltage compensation period VCP, as illustrated in FIG. 7, third and fifth transistors T3 and T5 may be turned on in response to the second scan signal SCAN2 having the on level. Thus, the fifth transistor T5 may apply a reference voltage VREF to the first node N1, or a first electrode of a second capacitor C2. In some embodiments, the reference voltage VREF may have a voltage level substantially the same as a voltage level of a first power supply voltage ELVDD, but the voltage level of the reference voltage VREF is not limited thereto. Further, the third transistor T3 may diode-connect the first transistor T1. Accordingly, a voltage ELVDD−VTH where the threshold voltage VTH is subtracted from the first power supply voltage ELVDD may be applied through the diode-connected first transistor T1 to the second node N2, or a second electrode of the second capacitor C2. In some embodiments, a time length of the threshold voltage compensation period VCP may correspond to, but not limited to, three horizontal times (or a 3H time). Further, in some embodiments, as illustrated in FIG. 5, the threshold voltage compensation period VCP may be separated from the data writing period DWP, and the threshold voltage compensation period VCP may have the time length, for example the three horizontal times longer than a time length (e.g., corresponding to the 1H time) of the data writing period DWP. Thus, since the threshold voltage compensation period VCP has the time length longer than that of the data writing period DWP, the threshold voltage VTH of the first transistor T1 may be sufficiently compensated.

In the diode initialization period AIP (or an anode initialization period), the emission signal may have the off level, the fourth scan signal SCAN4 may have the on level, and the first, second, third and fifth scan signals SCAN1, SCAN2, SCAN3 and SCAN5 may have the off level. In the diode initialization period AIP, as illustrated in FIG. 8, a seventh transistor T7 may be turned on in response to the fourth scan signal SCAN4 having the on level. Thus, the initialization voltage VINT (or a second initialization voltage VINT2) may be applied to an anode of the organic light emitting diode EL through the seventh transistor T7, and the organic light emitting diode EL may be initialized. In some embodiments, a time length of the diode initialization period AIP may correspond to, but not limited to, one horizontal time (or a 1H time).

In the data writing period DWP, the emission signal may have the off level, the first scan signal SCAN1 may have the on level, and the second, third, fourth and fifth scan signals SCAN2, SCAN3, SCAN4 and SCAN5 may have the off level. In the data writing period DWP, as illustrated in FIG. 9, a second transistor T2 may be turned on in response to the first scan signal SCAN1 having the on level. Thus, the second transistor T2 may apply the data voltage VDAT to the first node N1, or the first electrode of the second capacitor C2. Accordingly, a voltage of the first electrode of the second capacitor C2 may be changed from the reference voltage VREF to the data voltage VDAT by a difference VDAT-VREF between the data voltage VDAT and the reference voltage VREF. If the voltage of the first electrode of the second capacitor C2 is changed by the difference VDAT-VREF between the data voltage VDAT and the reference voltage VREF, a voltage of the second electrode of the second capacitor C2 in a floating state also may be changed by the difference VDAT-VREF between the data voltage VDAT and the reference voltage VREF. Accordingly, in the data writing period DWP, the voltage of the second electrode of the second capacitor C2, or a voltage of the second node N2 may become a voltage ELVDD−VTH+VDAT−VREF where the difference VDAT-VREF between the data voltage VDAT and the reference voltage VREF is added to the voltage ELVDD−VTH where the threshold voltage VTH is subtracted from the first power supply voltage ELVDD. In some embodiments, a time length of the data writing period DWP may correspond to, but not limited to, one horizontal time (or a 1H time).

In the emission period EMP, the emission signal may have the on level, and the first, second, third, fourth and fifth scan signals SCAN1, SCAN2, SCAN5, SCAN4 and SCAN5 may have the off level. In the emission period EMP, as illustrated in FIG. 10, a sixth transistor T6 may be turned on in response to the emission signal EM having the on level. Thus, the first transistor T1 may generate a driving current IDR based on the voltage ELVDD−VTH+VDAT−VREF of the second node N2, or the voltage ELVDD−VTH+VDAT−VREF of the second electrode of the second capacitor C2, the sixth transistor T6 may provide the driving current IDR to the organic light emitting diode EL, and the organic light emitting diode EL may emit light based on the driving current IDR. The driving current IDR generated by the first transistor T1 may be determined according to an equation, "β/2*(VSG−VTH)^2". Here, β may be a transistor gain determined by a mobility, a capacitance, a width and a length of the first transistor T1, VSG may be a source-gate voltage of the first transistor T1, and VTH may be the threshold voltage of the first transistor T1. Further, since a source voltage of the first transistor T1 is the first power supply voltage ELVDD, and a gate voltage of the first transistor T1 is the voltage of the second node N2, or "VDD−VTH+VDAT−VREF", "VSG−VTH" may be "VDD−ELVDD+VTH−VDAT+VREF—VTH=VREF—VDAT". Thus, the driving current IDR may be determined based on the reference data VREF and the data voltage VDAT regardless of the threshold voltage VTH of the first transistor T1.

Figure 11:
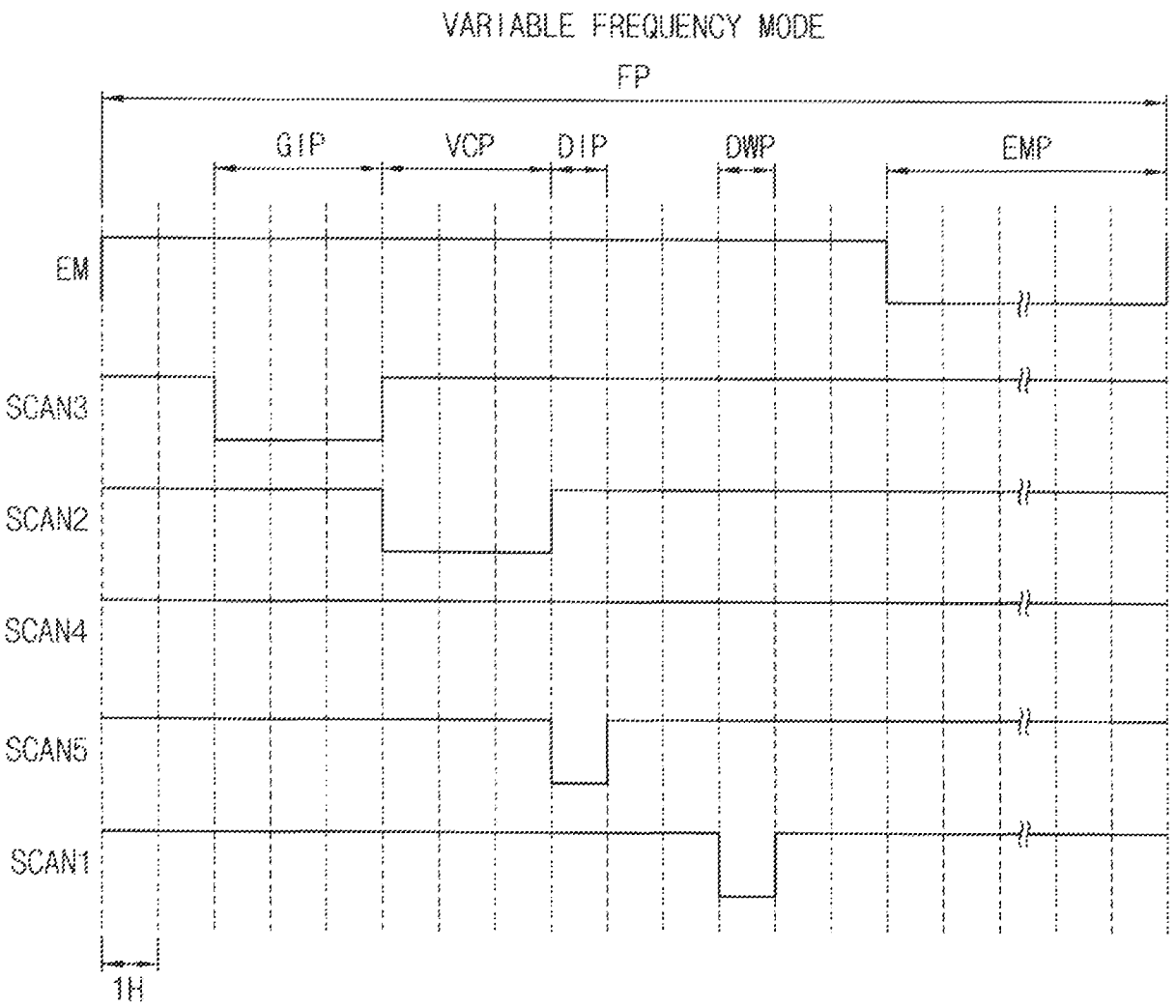
FIG. 11 is a timing diagram for describing an operation of a pixel in a variable frequency mode according to embodiments.
Figure 12:
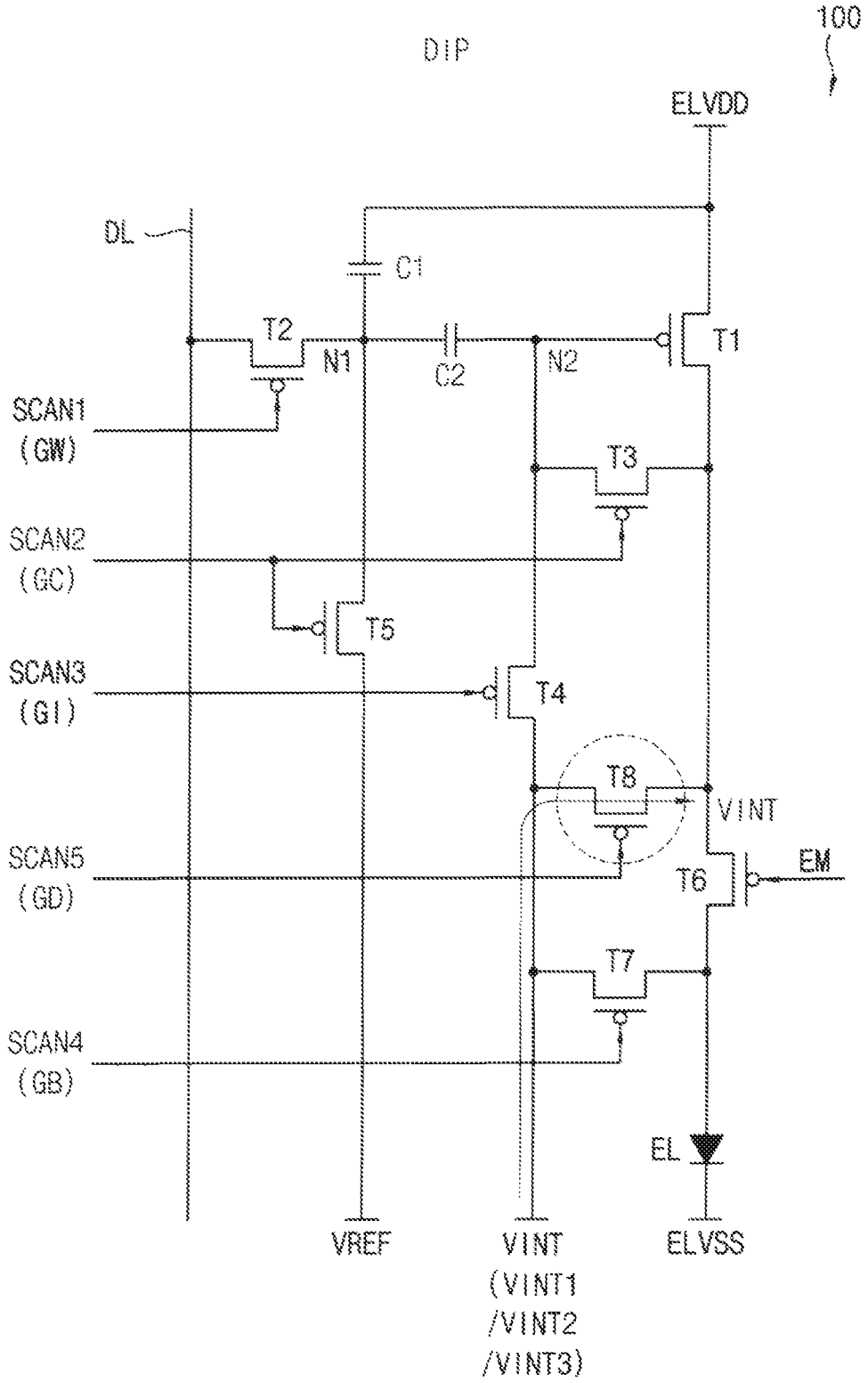
FIG. 12 is a circuit diagram for describing an example of an operation of a pixel in a drain initialization period.

FIG. 11 is a timing diagram for describing an operation of a pixel in a variable frequency mode according to embodiments, and FIG. 12 is a circuit diagram for describing an example of an operation of a pixel in a drain initialization period.

Referring to FIGS. 1 and 11, each frame period FP in a variable frequency mode in which a display panel is driven at a variable frame frequency may include a gate initialization period GIP, a threshold voltage compensation period VCP, a drain initialization period DIP in which a drain of a first transistor T1 is initialized, a data writing period DWP and an emission period EMP. Operations of a pixel 100 in the gate initialization period GIP, the threshold voltage compensation period VCP, the data writing period DWP and the emission period EMP in the variable frequency mode may be substantially the same as operations of the pixel 100 in a normal mode described above with reference to FIGS. 6, 7, 9 and 10.

In the drain initialization period DIP, an emission signal may have an off level, a fifth scan signal SCAN5 may have an on level, and first, second, third and fourth scan signals SCAN1, SCAN2, SCAN3 and SCAN4 may have the off level. In the drain initialization period DIP, as illustrated in FIG. 12, an eighth transistor T8 may be turned on in response to the fifth scan signal SCAN5 having the on level. Thus, the eighth transistor T8 may apply an initialization voltage VINT (or a third initialization voltage VINT3) to the drain of the first transistor T1, and the drain of the first transistor T1 may be initialized. In some embodiments, a time length of the drain initialization period DIP may correspond to, but not limited to, one horizontal time (or a 1H time).

Figure 13:
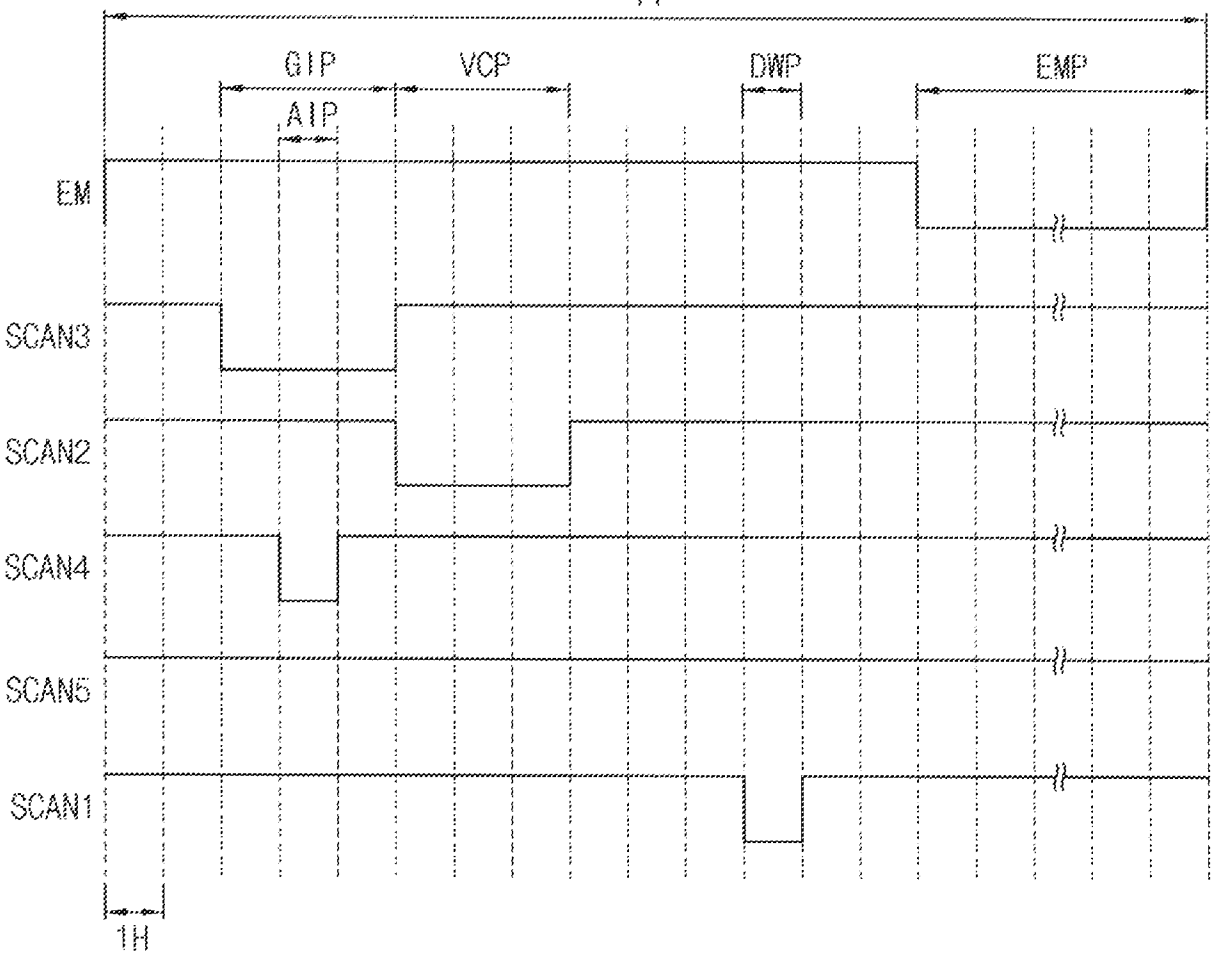
FIG. 13 is a timing diagram for describing an operation of a pixel in a normal mode according to embodiments.
Figure 14:
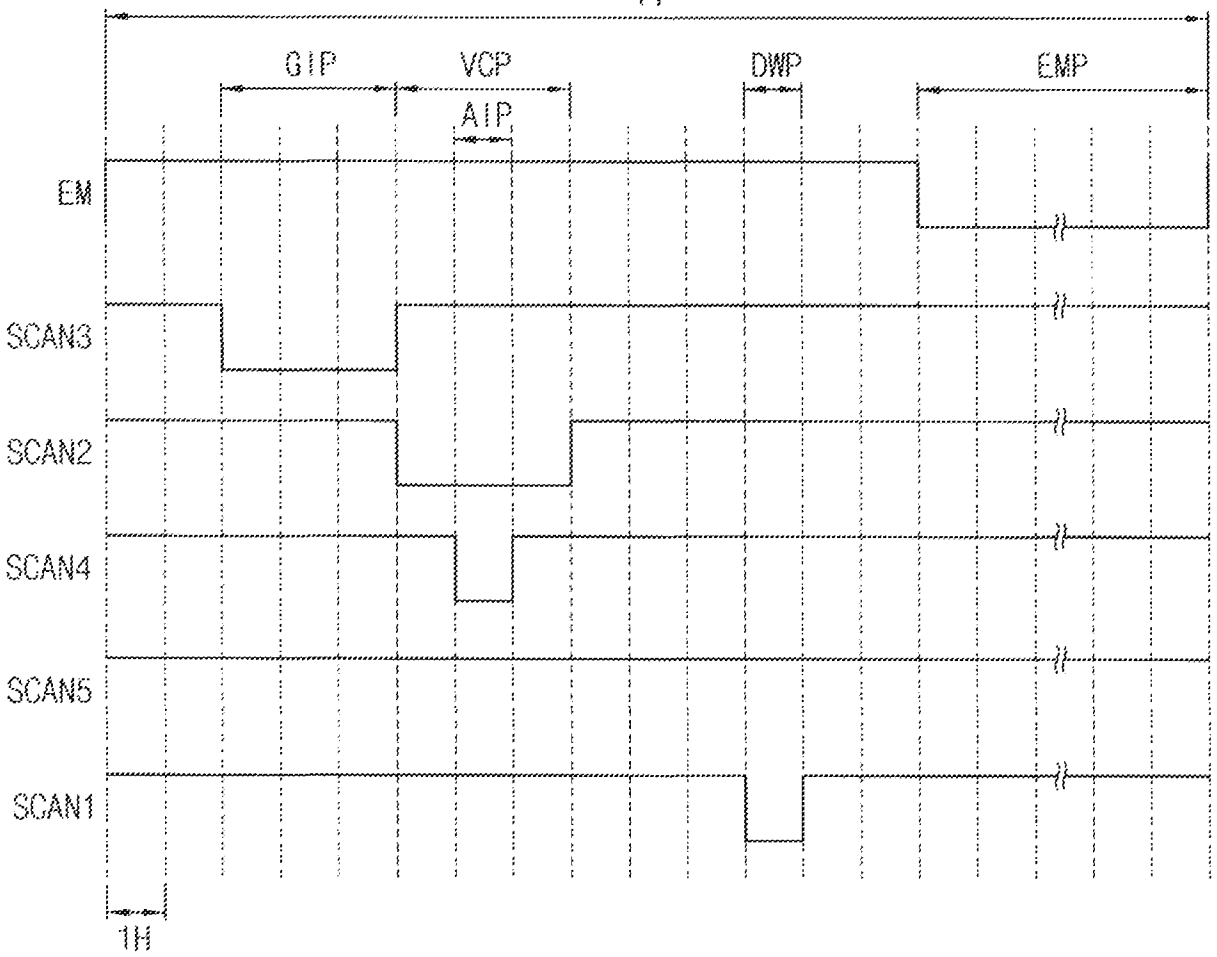
FIG. 14 is a timing diagram for describing an operation of a pixel in a normal mode according to embodiments.

FIG. 13 is a timing diagram for describing an operation of a pixel in a normal mode according to embodiments, and FIG. 14 is a timing diagram for describing an operation of a pixel in a normal mode according to embodiments.

Referring to FIGS. 13 and 14, in some embodiments, a diode initialization period AIP in a normal mode may overlap a gate initialization period GIP or a threshold voltage compensation period VCP. In an example, as illustrated in FIG. 13, the diode initialization period AIP may overlap the gate initialization period GIP. In another example, as illustrated in FIG. 14, the diode initialization period AIP may overlap the threshold voltage compensation period VCP.

Figure 15:
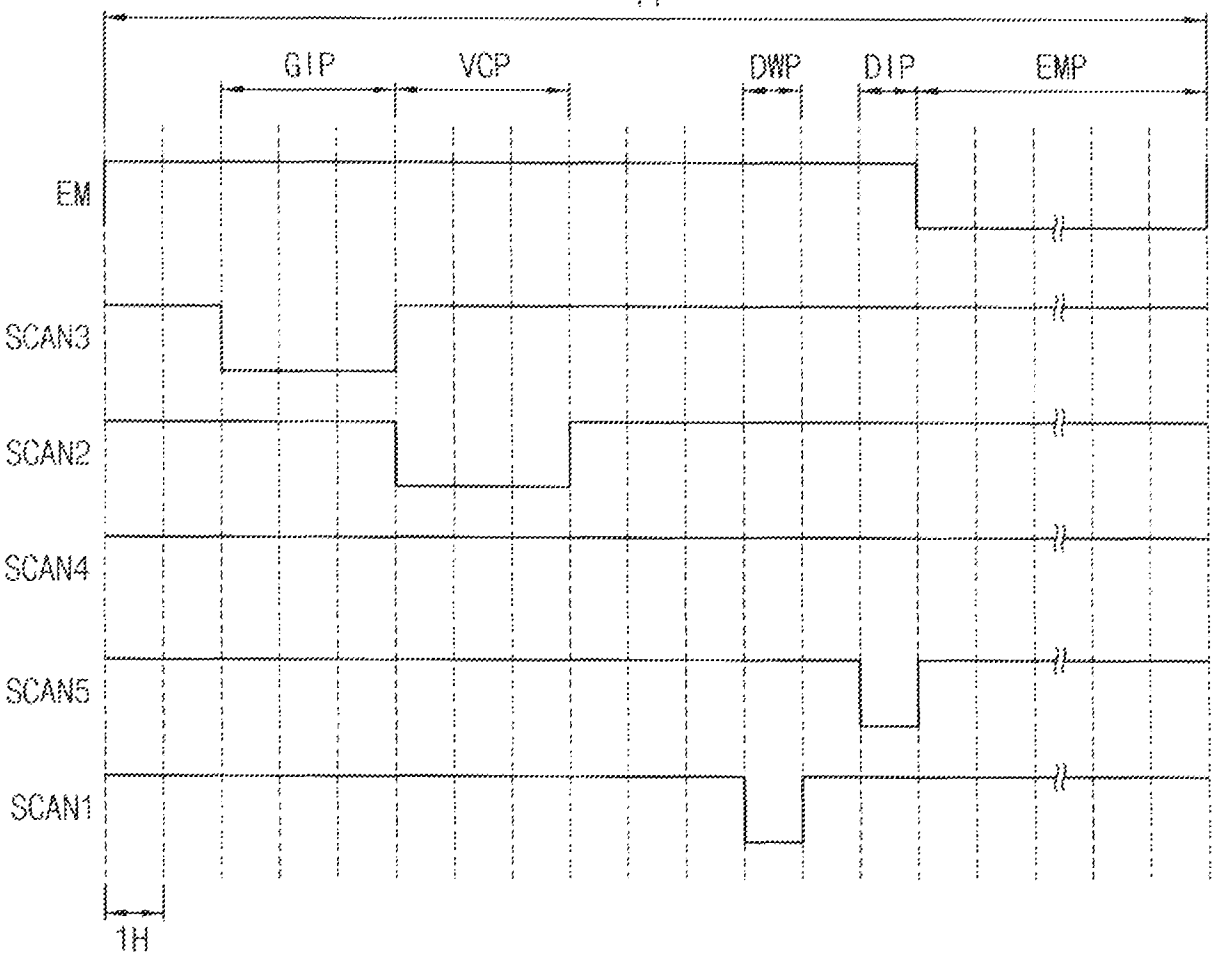
FIG. 15 is a timing diagram for describing an operation of a pixel in a variable frequency mode according to embodiments.

FIG. 15 is a timing diagram for describing an operation of a pixel in a variable frequency mode according to embodiments.

Referring to FIG. 15, in some embodiments, a drain initialization period DIP in a variable frequency mode may be located between a data writing period DWP and an emission period EMP. For example, as illustrated in FIG. 15, the drain initialization period DIP may be located after the data writing period DWP and before the emission period EMP.

Figure 16:
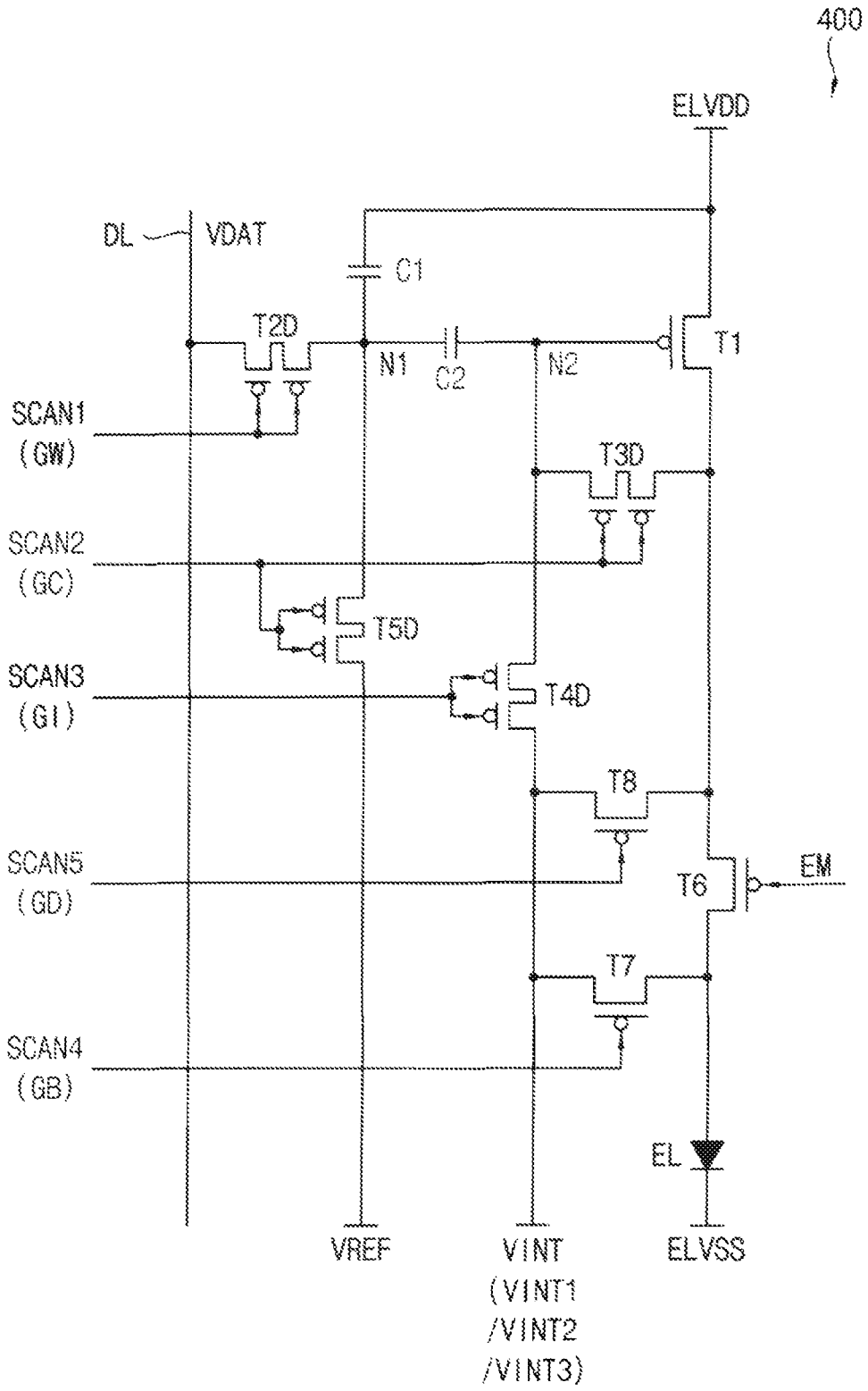
FIG. 16 is a circuit diagram illustrating a pixel of an OLED display device according to embodiments.

FIG. 16 is a circuit diagram illustrating a pixel of an OLED display device according to embodiments.

Referring to FIG. 16, a pixel 400 of an OLED display device according to embodiments may include a first capacitor C1, a second capacitor C2, a first transistor T1, a second transistor T2D, a third transistor T3D, a fourth transistor T4D, a fifth transistor T5D, a sixth transistor T6, a seventh transistor T7, an eighth transistor T8 and an organic light emitting diode EL. The pixel 400 of FIG. 16 may have a similar configuration and a similar operation to a pixel 100 of FIG. 1 except that at least one of the first, second, third, fourth, fifth, sixth, seventh and eighth transistors T1, T2D, T3D, T4D, T5D, T6, T7 and T8 may be implemented with a dual transistor in which two sub-transistors are serially connected.

In some embodiments, as illustrated in FIG. 16, each of the second transistor T2D, the third transistor T3D, the fourth transistor T4D and the fifth transistor T5D may be implemented with the dual transistor including sub-transistors connected in series. Since the second through fifth transistors T2D through T5D directly coupled to the first and second capacitors C1 and C2 are implemented with the dual transistors, leakage currents through the second through fifth transistors T2D through T5D from/to the first and second capacitors C1 and C2 may be reduced. Thus, in a variable frequency mode, the pixel 400 or a display panel including the pixel 400 may display an image with a uniform luminance during one frame period.

Figure 17:
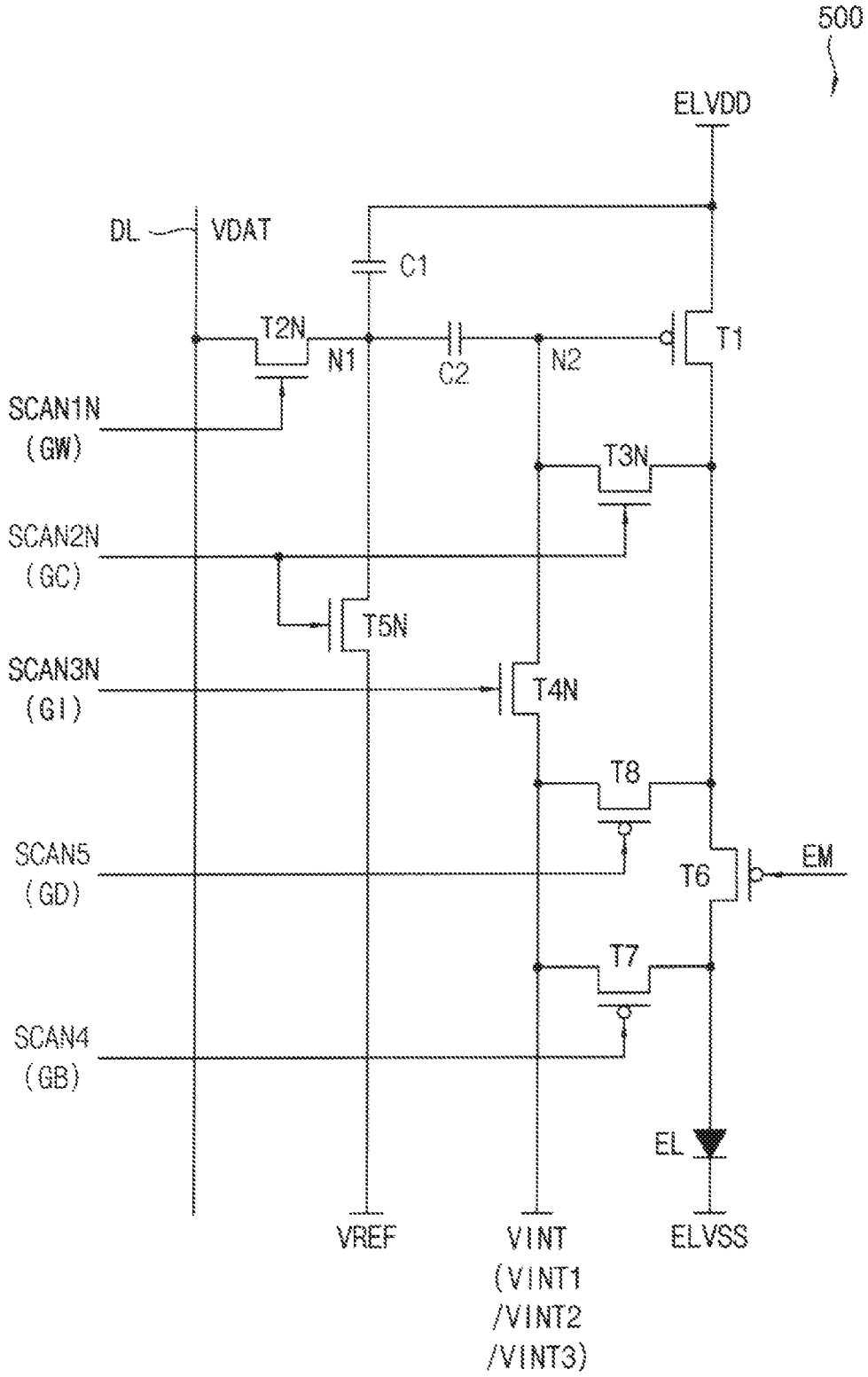
FIG. 17 is a circuit diagram illustrating a pixel of an OLED display device according to embodiments.

FIG. 17 is a circuit diagram illustrating a pixel of an OLED display device according to embodiments.

Referring to FIG. 17, a pixel 500 of an OLED display device according to embodiments may include a first capacitor C1, a second capacitor C2, a first transistor T1, a second transistor T2N, a third transistor T3N, a fourth transistor T4N, a fifth transistor T5N, a sixth transistor T6, a seventh transistor T7, an eighth transistor T8 and an organic light emitting diode EL. The pixel 500 of FIG. 17 may have a similar configuration and a similar operation to a pixel 100 of FIG. 1 except that a first portion of the first, second, third, fourth, fifth, sixth, seventh and eighth transistors T1, T2N, T3N, T4N, T5N, T6, T7 and T8 may be implemented with a p-type metal oxide semiconductor (PMOS) transistor, and a second portion of the first, second, third, fourth, fifth, sixth, seventh and eighth transistors T1, T2N, T3N, T4N, T5N, T6, T7 and T8 may be implemented with an n-type metal oxide semiconductor (NMOS) transistor.

In some embodiments, as illustrated in FIG. 17, the second transistor T2N, the third transistor T3N, the fourth transistor T4N and the fifth transistor T5N may be implemented with the NMOS transistors having relatively small leakage current than the PMOS transistors. In this case, unlike examples of FIGS. 5, 11, 13, 14 and 15 where first, second and third scan signals SCAN1, SCAN2 and SCAN5 are active low signals having a low level as an on level and a high level as an off level, first, second and third scan signals SCAN1N, SCAN2N and SCAN3N applied to the second, third, fourth and fifth transistors T2N, T3N, T4N and T5N implemented with the NMOS transistors may be active high signals having a high level as the on level and a low level as the off level. Since the second through fifth transistors T2N through T5N directly coupled to the first and second capacitors C1 and C2 are implemented with the NMOS transistors, leakage currents through the second through fifth transistors T2N through T5N from/to the first and second capacitors C1 and C2 may be reduced. Thus, in a variable frequency mode, the pixel 500 or a display panel including the pixel 500 may display an image with a uniform luminance during one frame period.

Although FIG. 17 illustrates an example where the second through fifth transistors T2N through T5N are implemented with the NMOS transistors, according to embodiments, any one or more transistors of the first through eighth transistors T1 through T8 may be implemented with the NMOS transistors. In some embodiments, the third and fourth transistors T3N and T4N of which sources/drains are directly coupled to a second node N2 may be implemented with the NMOS transistors, and thus leakage currents through the third and fourth transistors T3N and T4N from/to the second node N2 may be reduced. In other embodiments, the second and fifth transistors T2N and T5N of which sources/drains are directly coupled to a first node N1 may be implemented with the NMOS transistors, and thus leakage currents through the second and fifth transistors T2N and T5N from/to the first node N1 may be reduced.

Figure 18:
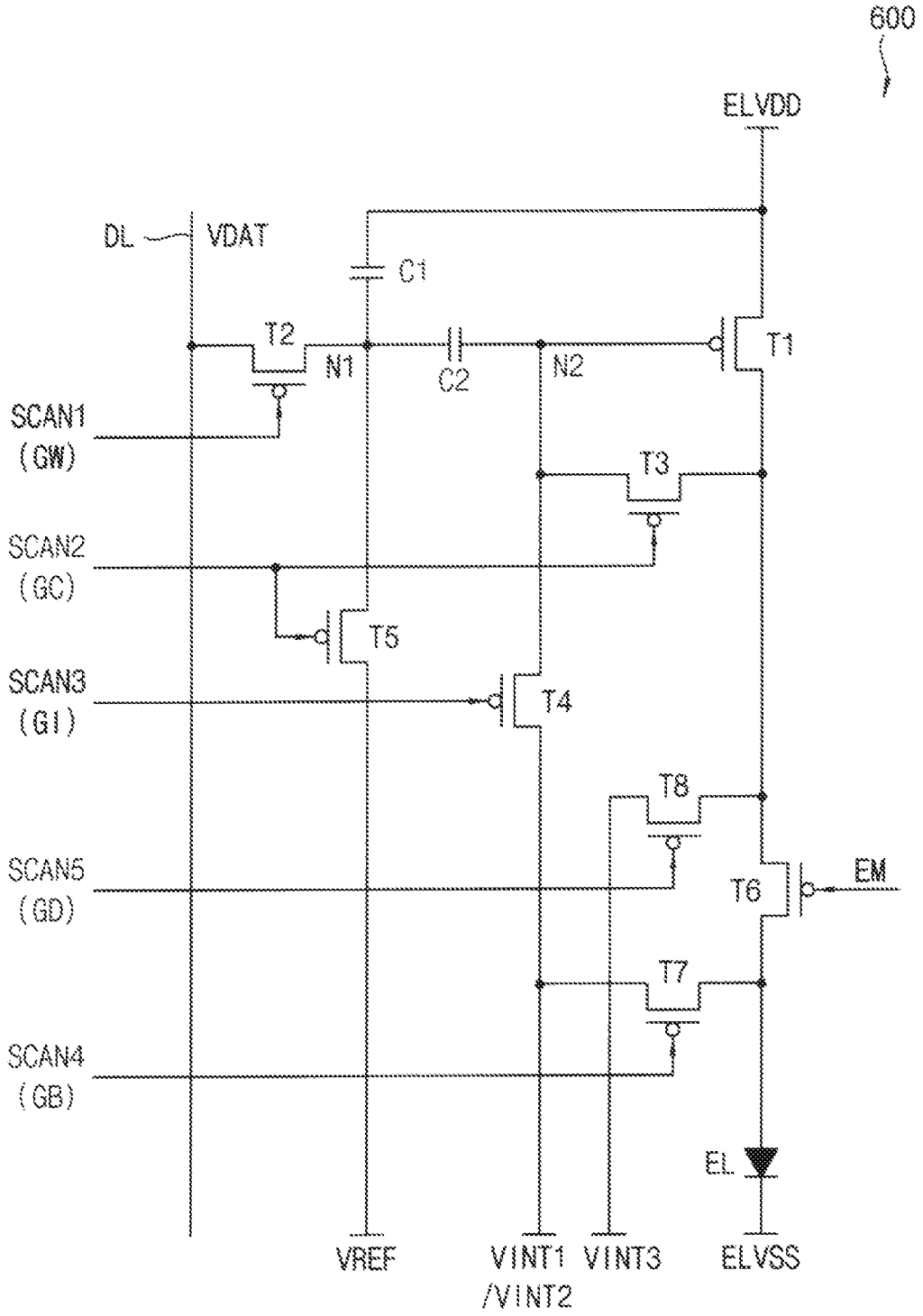
FIG. 18 is a circuit diagram illustrating a pixel of an OLED display device according to embodiments.
Figure 19:
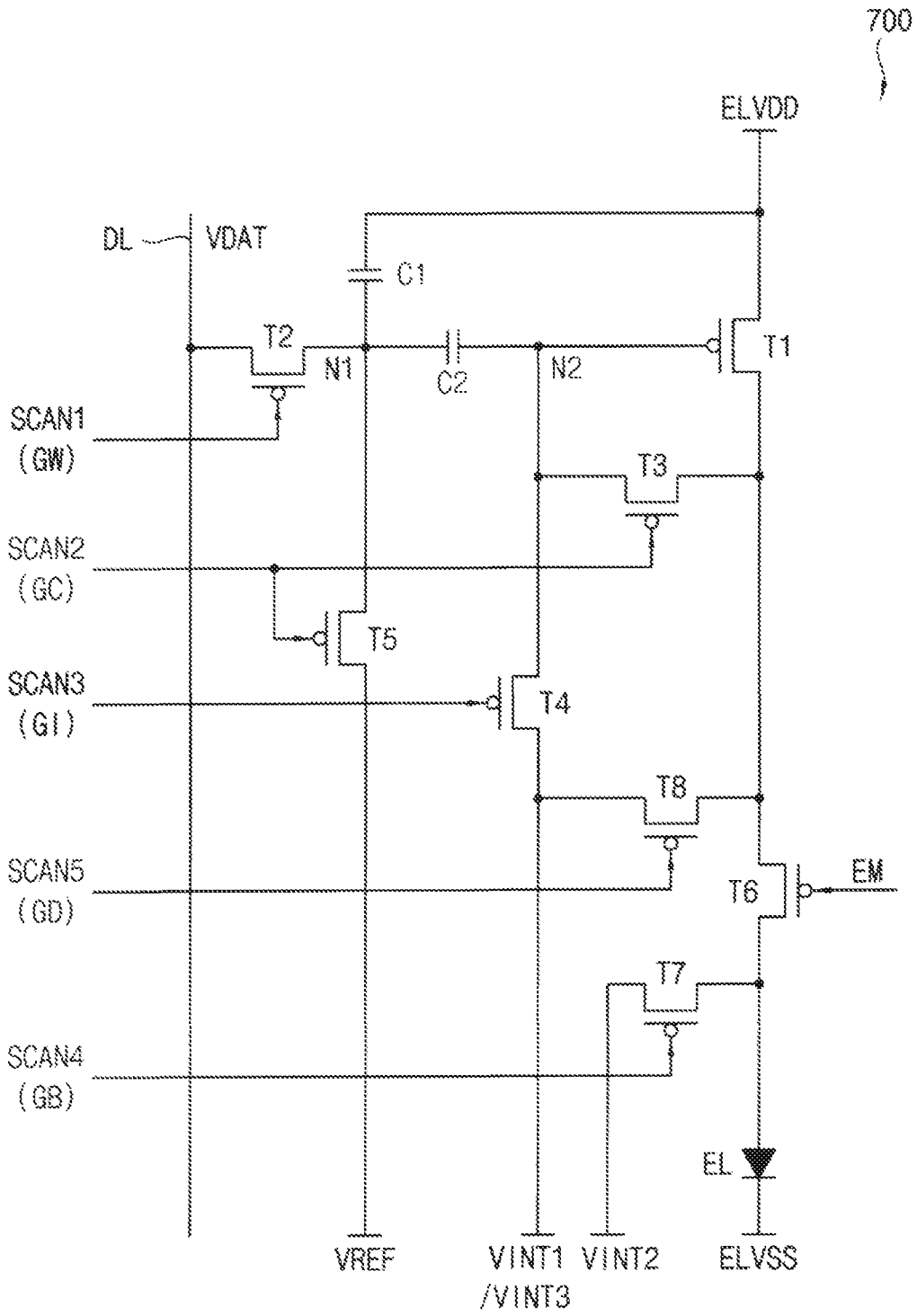
FIG. 19 is a circuit diagram illustrating a pixel of an OLED display device according to embodiments.
Figure 20:
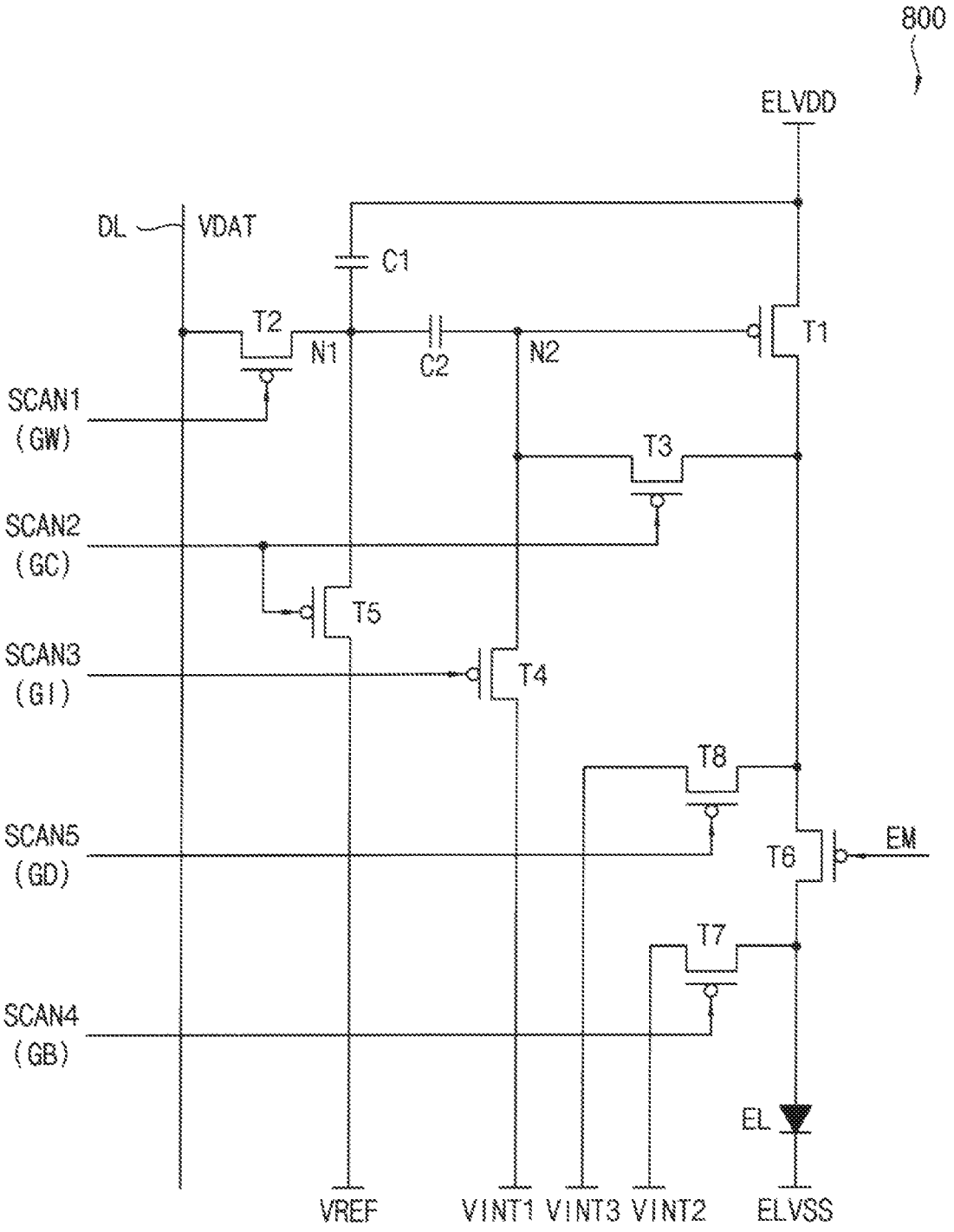
FIG. 20 is a circuit diagram illustrating a pixel of an OLED display device according to embodiments.

FIG. 18 is a circuit diagram illustrating a pixel of an OLED display device according to embodiments, FIG. 19 is a circuit diagram illustrating a pixel of an OLED display device according to embodiments, and FIG. 20 is a circuit diagram illustrating a pixel of an OLED display device according to embodiments.

Referring to FIGS. 18, 19 and 20, a pixel 600, 700 and 800 of an OLED display device according to embodiments may include a first capacitor C1, a second capacitor C2, a first transistor T1, a second transistor T2, a third transistor T3, a fourth transistor T4, a fifth transistor T5, a sixth transistor T6, a seventh transistor T7, an eighth transistor T8 and an organic light emitting diode EL. Each of the pixel 600 of FIG. 18, the pixel 700 of FIG. 19 and the pixel 800 of FIG. 20 may have a similar configuration and a similar operation to a pixel 100 of FIG. 1 except that a second initialization voltage VINT2 for diode initialization (or anode initialization) which is applied via the seventh transistor T7, and a third initialization voltage VINT3 for drain initialization which is applied via the eighth transistor T8 may be different voltages provided to the pixel 600, 700 and 800 through different lines.

In some embodiments, as illustrated in FIG. 18, a first initialization voltage VINT1 for gate initialization and the second initialization voltage VINT2 for the diode initialization may be the same voltage provided to the pixel 600 through the same line. However, the third initialization voltage VINT3 for the drain initialization may be provided to the pixel 600 through a line different from the line of the first/second initialization voltage VINT1/VINT2, and may be a voltage different from the first/second initialization voltage VINT1/VINT2. Since the first/second initialization voltage VINT1/VINT2 for the gate/diode initialization and the third initialization voltage VINT3 for the drain initialization are different voltages from different lines, each of the gate/diode initialization and the drain initialization may be sufficiently and suitably performed.

In other embodiments, as illustrated in FIG. 19, the first initialization voltage VINT1 for the gate initialization and the third initialization voltage VINT3 for the drain initialization may be the same voltage provided to the pixel 700 through the same line. However, the second initialization voltage VINT2 for the diode initialization may be provided to the pixel 700 through a line different from the line of the first/third initialization voltage VINT1/VINT3, and may be a voltage different from the first/third initialization voltage VINT1/VINT3. Since the first/third initialization voltage VINT1/VINT3 for the gate/drain initialization and the second initialization voltage VINT2 for the diode initialization are different voltages from different lines, each of the gate/drain initialization and the diode initialization may be sufficiently and suitably performed.

In still other embodiments, as illustrated in FIG. 20, the first initialization voltage VINT1 for the gate initialization, the second initialization voltage VINT2 for the diode initialization and the third initialization voltage VINT3 for the drain initialization may be different voltages provided to the pixel 800 through different lines. Since the first initialization voltage VINT1 for the gate initialization, the second initialization voltage VINT2 for the diode initialization and the third initialization voltage VINT3 for the drain initialization are different voltages from different lines, each of the gate initialization, the diode initialization and the drain initialization may be sufficiently and suitably performed.

Figure 21:
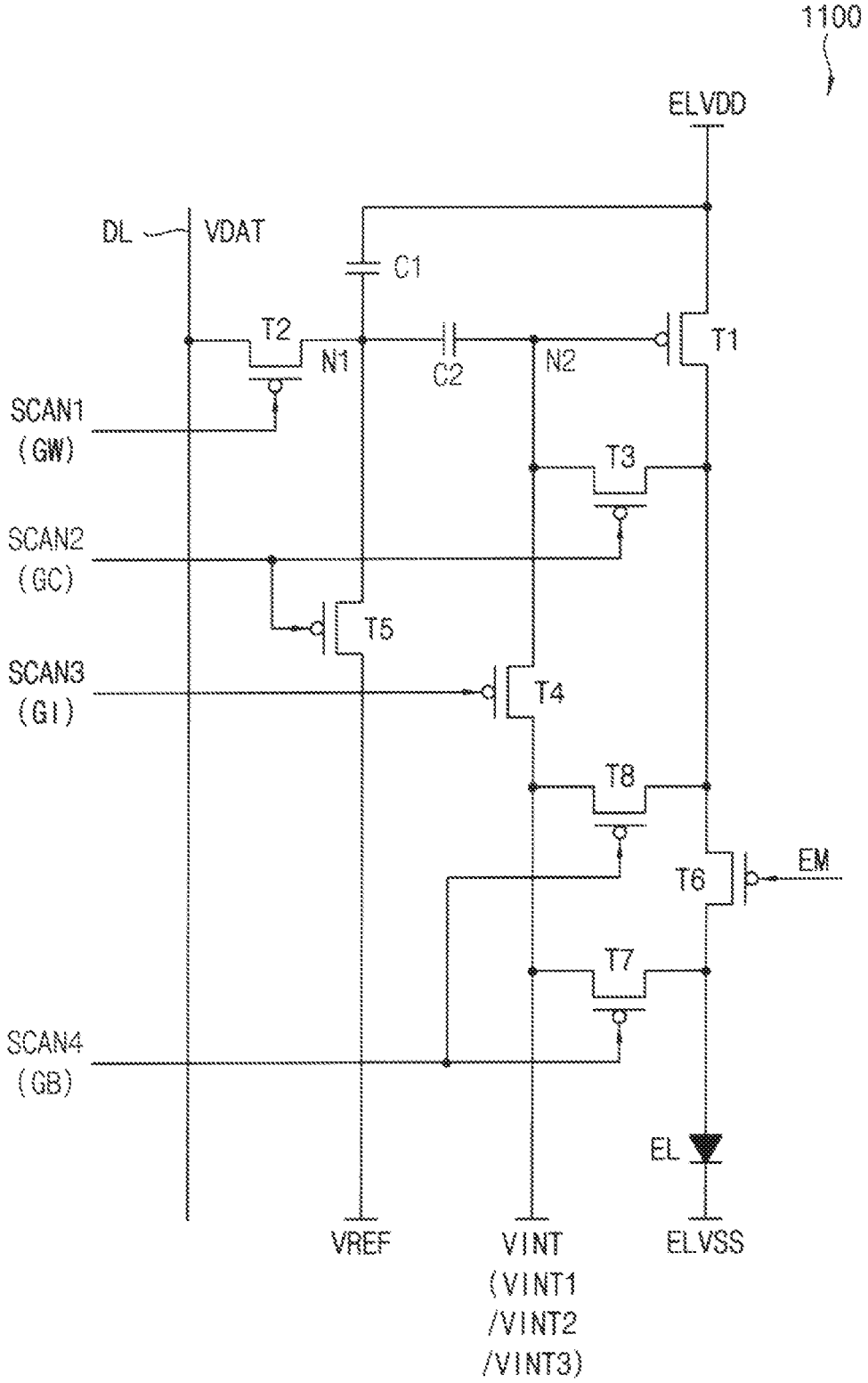
FIG. 21 is a circuit diagram illustrating a pixel of an OLED display device according to embodiments.
Figure 22:
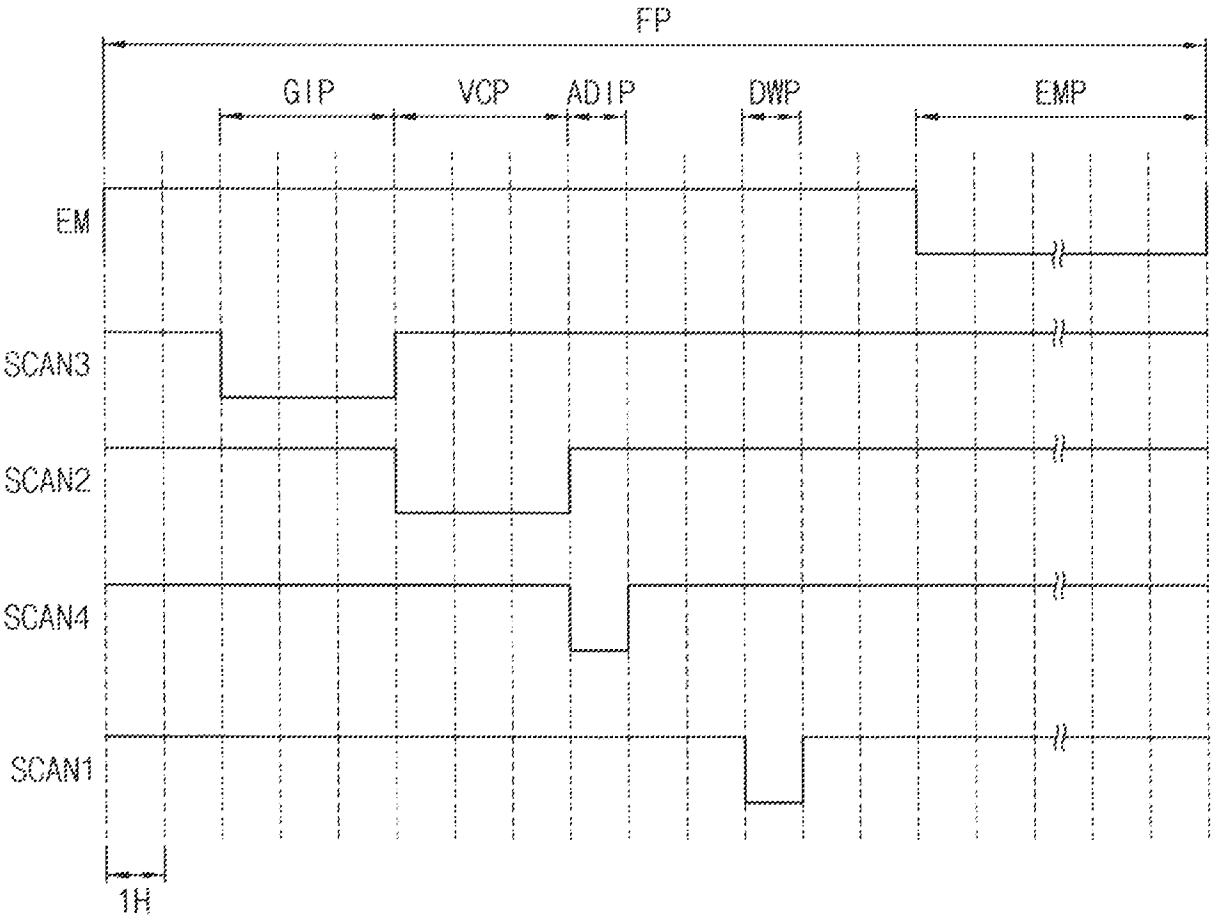
FIG. 22 is a timing diagram for describing an operation of a pixel of an OLED display device according to embodiments.

FIG. 21 is a circuit diagram illustrating a pixel of an OLED display device according to embodiments, and FIG. 22 is a timing diagram for describing an operation of a pixel of an OLED display device according to embodiments.

Referring to FIG. 21, a pixel 1100 of an OLED display device according to embodiments may include a first capacitor C1, a second capacitor C2, a first transistor T1, a second transistor T2, a third transistor T3, a fourth transistor T4, a fifth transistor T5, a sixth transistor T6, a seventh transistor T7, an eighth transistor T8 and an organic light emitting diode EL. The pixel 1100 of FIG. 21 may have a similar configuration and a similar operation to a pixel 100 of FIG. 1 except that the seventh transistor T7 and the eighth transistor T8 may receive the same scan signal SCAN4 through the same line.

In some embodiments, as illustrated in FIG. 21, the seventh transistor T7 and the eighth transistor T8 may receive the same fourth scan signal SCAN4, for example the same gate bypass signal GB. An operation of the pixel 1100 in a variable frequency mode may be substantially the same as an operation of the pixel 1100 in a normal mode. Further, in some embodiments, although a frame period in the variable frequency mode has a variable time length and a frame period in the normal mode has a constant time length, each of the frame period in the variable frequency mode and the frame period in the normal mode may include substantially the same periods.

For example, as illustrated in FIG. 22, each frame period FP in the normal mode and the variable frequency mode may include a gate initialization period GIP in which a gate of the first transistor T1 is initialized, a threshold voltage compensation period VCP in which a threshold voltage of the first transistor T1 is compensated, a diode and drain initialization period ADIP in which the organic light emitting diode EL and a drain of the first transistor T1 are initialized, a data writing period DWP in which a data voltage VDAT is applied to a first node N1, and an emission period EMP in which the organic light emitting diode EL emits light. Operations of a pixel 1100 in the gate initialization period GIP, the threshold voltage compensation period VCP, the data writing period DWP and the emission period EMP may be substantially the same as operations of the pixel 100 described above with reference to FIGS. 6, 7, 9 and 10.

In the diode and drain initialization period ADIP, the seventh transistor T7 and the eighth transistor T8 may be turned on in response to the fourth scan signal SCAN4 having an on level. The seventh transistor T7 may apply an initialization voltage VINT to an anode of the organic light emitting diode EL, and thus the organic light emitting diode EL may be initialized. Further, the eighth transistor T8 may apply the initialization voltage VINT to the drain of the first transistor T1, and thus the drain of the first transistor T1 may be initialized. In some embodiments, a time length of the diode and drain initialization period ADIP may correspond to, but not limited to, one horizontal time (or a 1H time).

Figure 23:
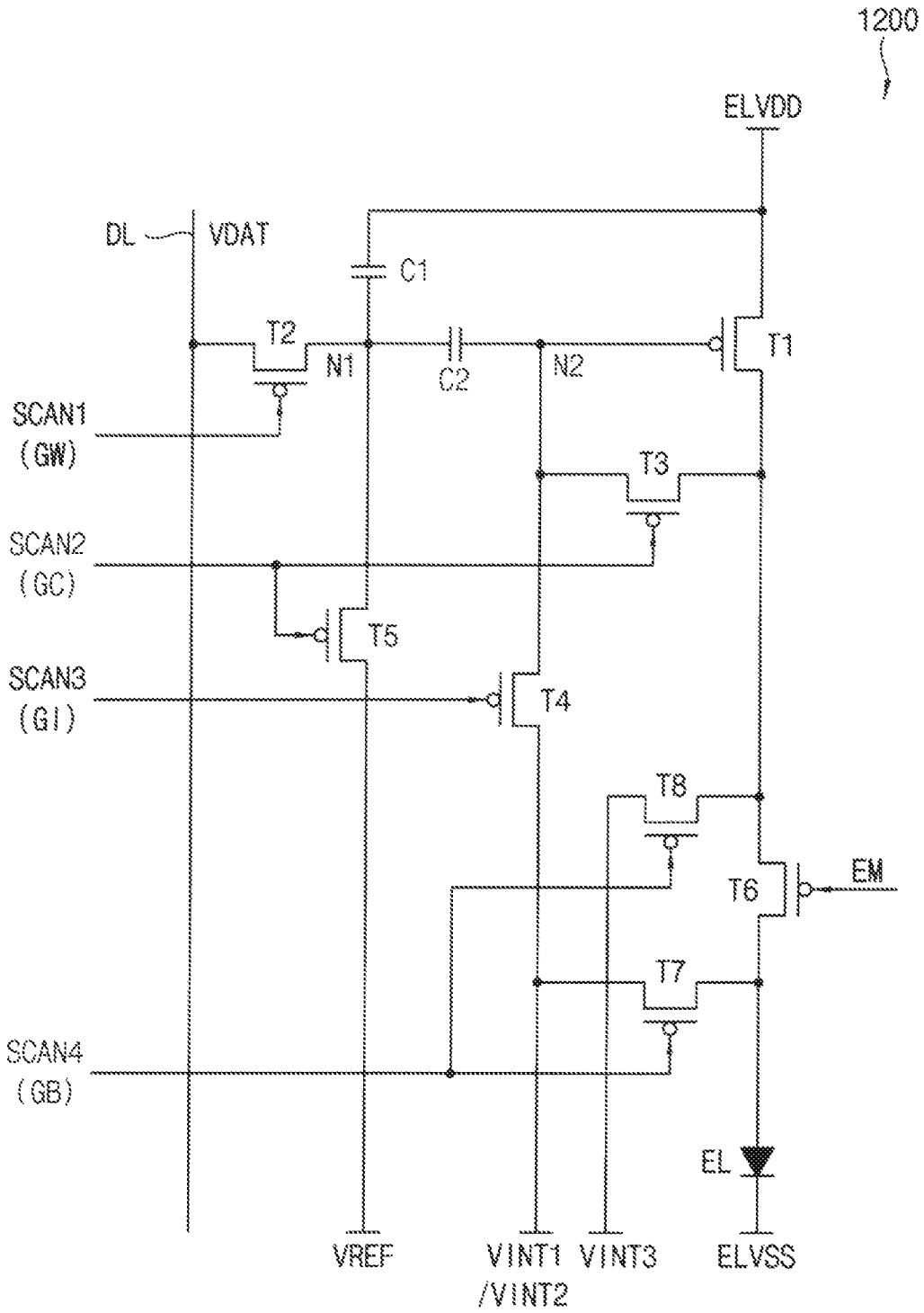
FIG. 23 is a circuit diagram illustrating a pixel of an OLED display device according to embodiments.
Figure 24:
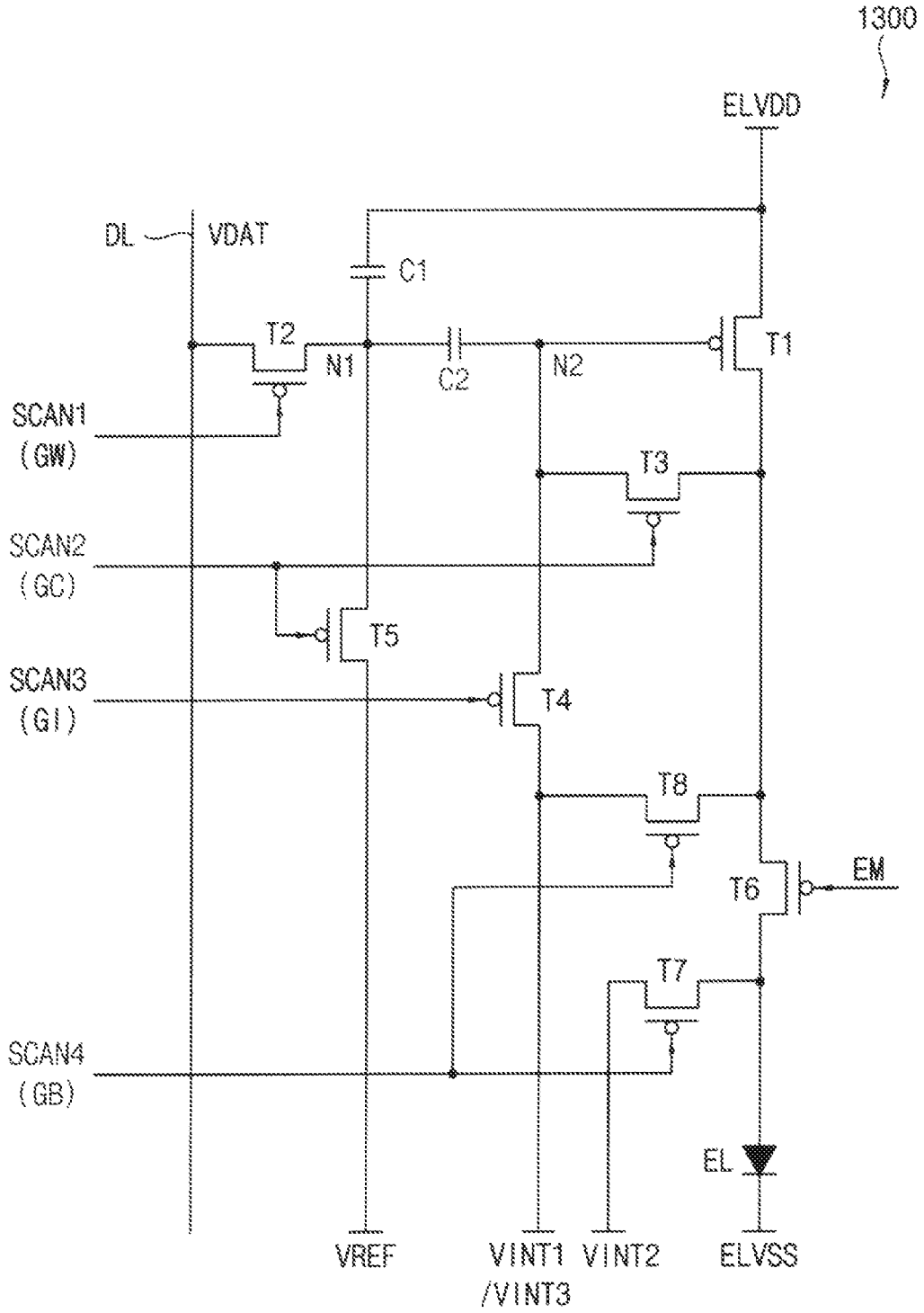
FIG. 24 is a circuit diagram illustrating a pixel of an OLED display device according to embodiments.
Figure 25:
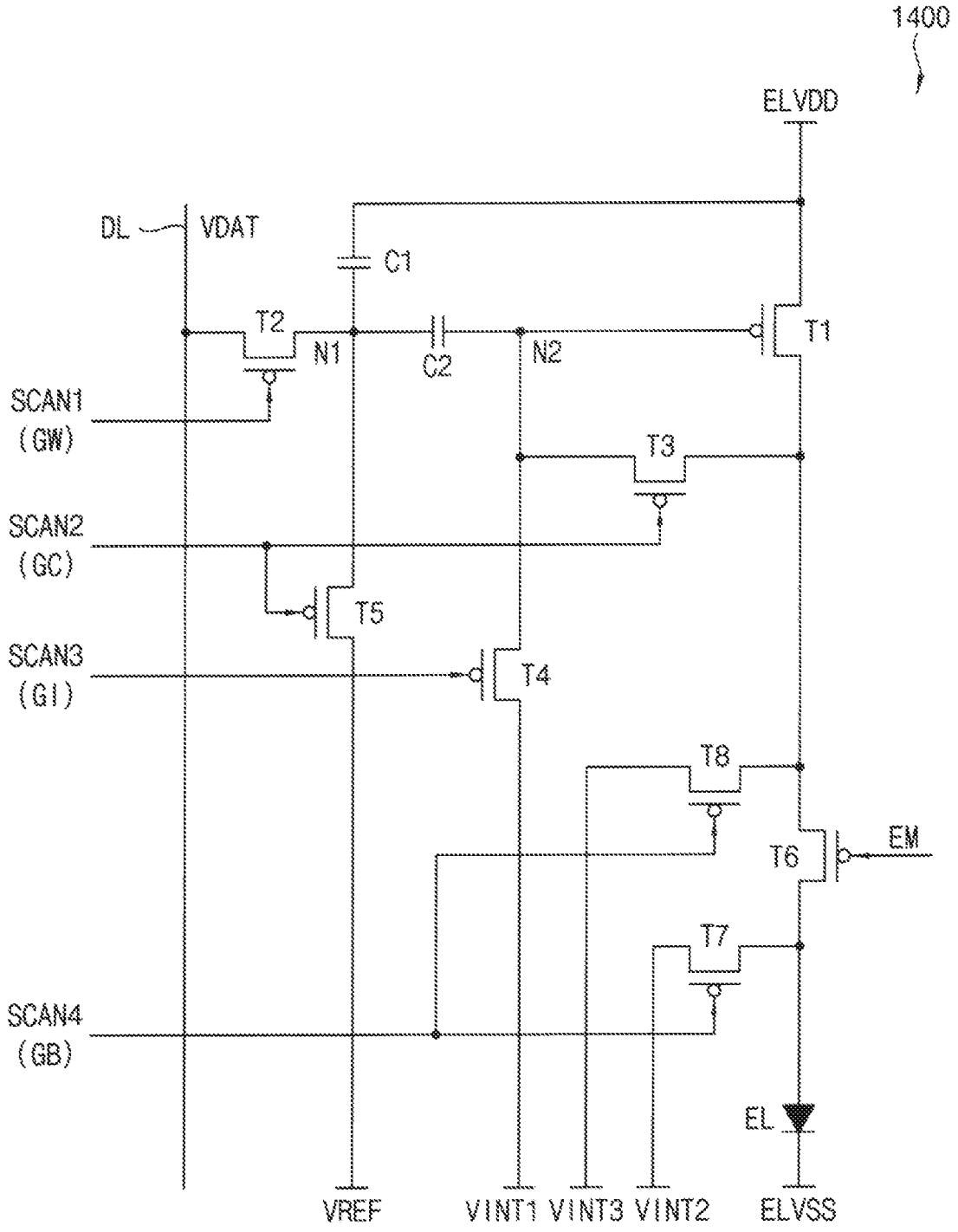
FIG. 25 is a circuit diagram illustrating a pixel of an OLED display device according to embodiments.

FIG. 23 is a circuit diagram illustrating a pixel of an OLED display device according to embodiments, FIG. 24 is a circuit diagram illustrating a pixel of an OLED display device according to embodiments, and FIG. 25 is a circuit diagram illustrating a pixel of an OLED display device according to embodiments.

Referring to FIGS. 23, 24 and 25, a pixel 1200, 1300 and 1400 of an OLED display device according to embodiments may include a first capacitor C1, a second capacitor C2, a first transistor T1, a second transistor T2, a third transistor T3, a fourth transistor T4, a fifth transistor T5, a sixth transistor T6, a seventh transistor T7, an eighth transistor T8 and an organic light emitting diode EL. Each of the pixel 1200 of FIG. 23, the pixel 1300 of FIG. 24 and the pixel 1400 of FIG. 25 may have a similar configuration and a similar operation to a pixel 1100 of FIG. 21 except that a second initialization voltage VINT2 for diode initialization (or anode initialization) which is applied via the seventh transistor T7, and a third initialization voltage VINT3 for drain initialization which is applied via the eighth transistor T8 may be different voltages provided to the pixel 1200, 1300 and 1400 through different lines.

In some embodiments, as illustrated in FIG. 23, a first initialization voltage VINT1 for the gate initialization and the second initialization voltage VINT2 for the diode initialization may be the same voltage provided to the pixel 1200 through the same line. However, the third initialization voltage VINT3 for the drain initialization may be provided to the pixel 1200 through a line different from the line of the first/second initialization voltage VINT1/VINT2, and may be a voltage different from the first/second initialization voltage VINT1/VINT2.

In other embodiments, as illustrated in FIG. 24, the first initialization voltage VINT1 for the gate initialization and the third initialization voltage VINT3 for the drain initialization may be the same voltage provided to the pixel 1300 through the same line. However, the second initialization voltage VINT2 for the diode initialization may be provided to the pixel 1300 through a line different from the line of the first/third initialization voltage VINT1/VINT3, and may be a voltage different from the first/third initialization voltage VINT1/VINT3.

In still other embodiments, as illustrated in FIG. 25, the first initialization voltage VINT1 for the gate initialization, the second initialization voltage VINT2 for the diode initialization and the third initialization voltage VINT3 for the drain initialization may be different voltages provided to the pixel 1400 through different lines.

Figure 26:
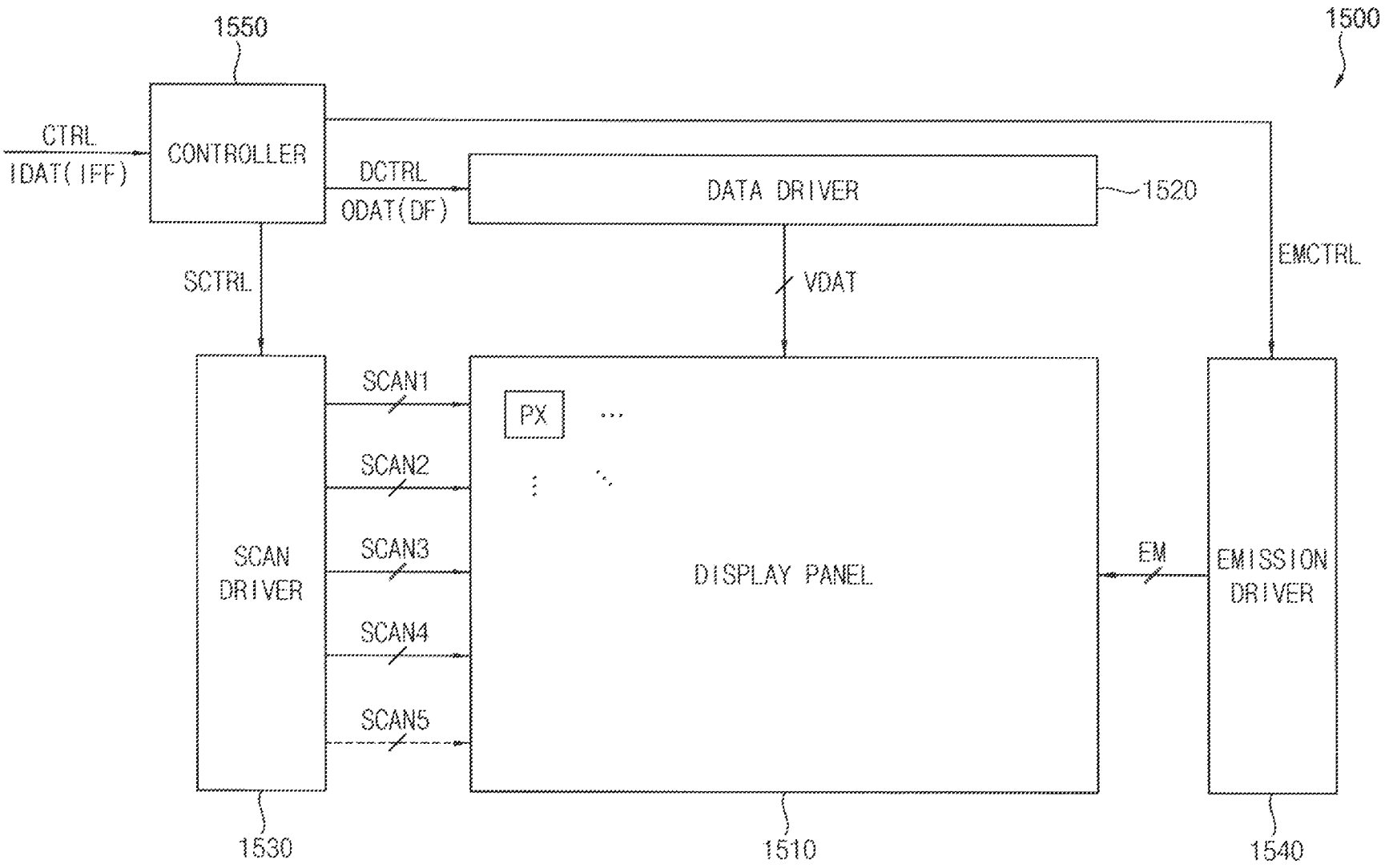
FIG. 26 is a block diagram illustrating an OLED display device according to embodiments.
Figure 27:
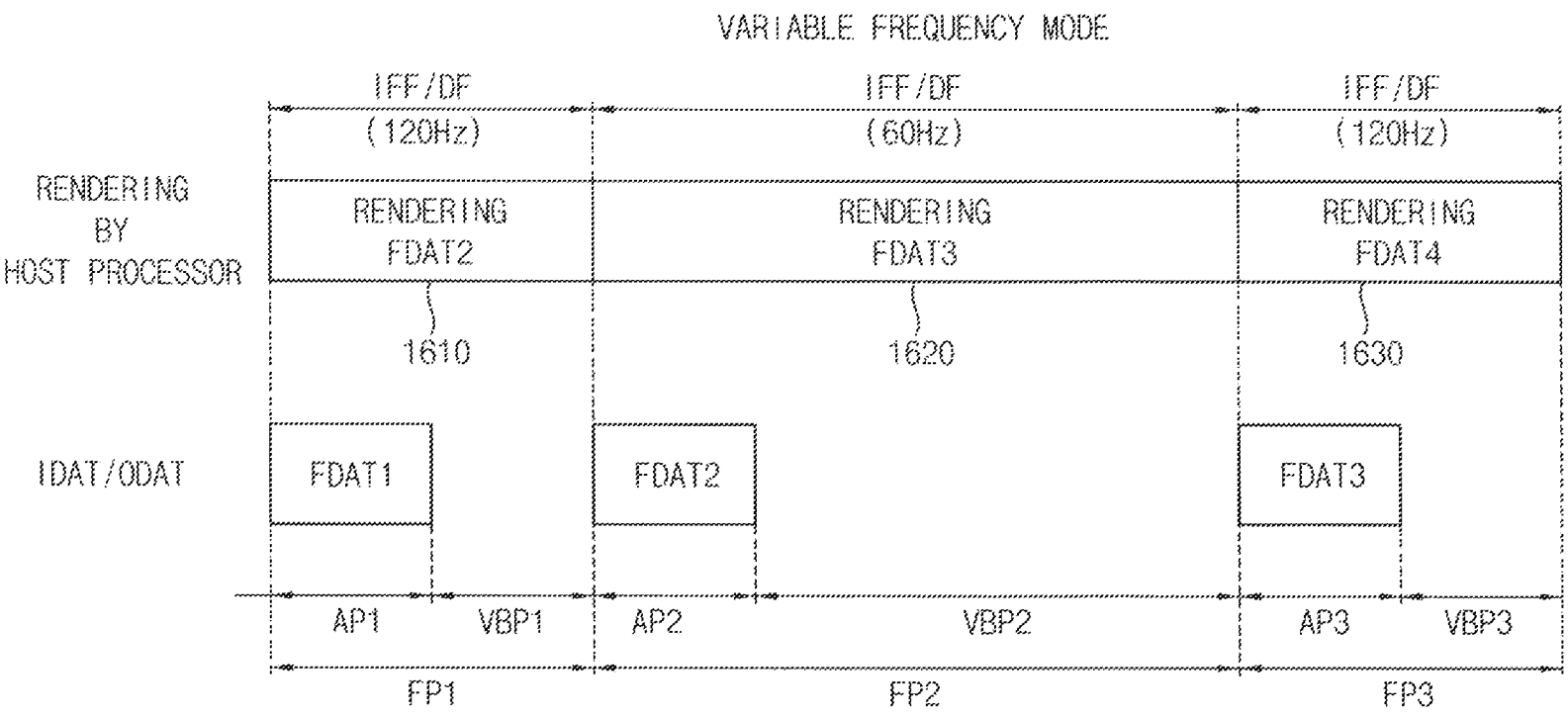
FIG. 27 is a diagram for describing an operation of an OLED display device in a variable frequency mode according to embodiments.

FIG. 26 is a block diagram illustrating an OLED display device according to embodiments, and FIG. 27 is a diagram for describing an operation of an OLED display device in a variable frequency mode according to embodiments.

Referring to FIG. 26, an OLED display device 1500 according to embodiments may include a display panel 1510, a data driver 1520, a scan driver 1530, an emission driver 1540 and a controller 1550.

The display panel 1510 may include a plurality of pixels PX. In the OLED display device 1500 according to embodiments, each pixel PX may include a first capacitor (e.g., a first capacitor C1 in FIG. 1) coupled between a line of a first power supply voltage and a first node, a second capacitor (e.g., a second capacitor C2 in FIG. 1) coupled between the first node and a second node, a driving transistor (e.g., a first transistor T1 in FIG. 1) configured to generate a driving current based on a voltage of the second node, a switching transistor (e.g., a second transistor T2 in FIG. 1) configured to transfer a data voltage VDAT to the first node in response to a gate writing signal (e.g., a first scan signal SCAN1 in FIG. 1), a gate initialization transistor (e.g., a fourth transistor T4 in FIG. 1) configured to transfer a gate initialization voltage (e.g., a first initialization voltage VINT1 in FIG. 1) to the second node in response to a gate initialization signal (e.g., a third scan signal SCAN3 in FIG. 1), an emission transistor (e.g., a sixth transistor T6 in FIG. 1) configured to couple a drain of the driving transistor and an anode of an organic light emitting diode in response to an emission signal EM, a drain initialization transistor (e.g., an eighth transistor T8 in FIG. 1) configured to transfer a drain initialization voltage (e.g., a third initialization voltage VINT3 in FIG. 1) to the drain of the driving transistor in response to a gate drain signal (e.g., a fifth scan signal SCAN5 in FIG. 1), and the organic light emitting diode including the anode, and a cathode coupled to a line of a second power supply voltage. For example, each pixel PX of the display panel 1510 may be the pixel 100 of FIG. 1, the pixel 400 of FIG. 16, the pixel 500 of FIG. 17, the pixel 600 of FIG. 18, the pixel 700 of FIG. 19, the pixel 800 of FIG. 20, the pixel 1100 of FIG. 21, the pixel 1200 of FIG. 23, the pixel 1300 of FIG. 24, the pixel 1400 of FIG. 25, or the like.

In the OLED display device 1500 according to embodiments, each pixel PX may include the drain initialization transistor (or the eighth transistor) for drain initialization. Accordingly, the pixel PX according to embodiments may be suitable not only for a normal mode but also for a variable frequency mode.

The data driver 1520 may provide data voltages VDAT to the plurality of pixels PX in response to a data control signal DCTRL and output image data ODAT received from the controller 1550. In some embodiments, the data control signal DCTRL may include, but not limited to, an output data enable signal, a horizontal start signal and a load signal. The data driver 1520 may receive the output image data ODAT as frame data at a driving frequency DF of the display panel 1510. In some embodiments, the data driver 1520 and the controller 1550 may be embedded in a signal integrated circuit chip, and the signal integrated circuit chip may be referred to as a timing controller embedded data driver (TED). In other embodiments, the data driver 1520 and the controller 1550 may be implemented with separate integrated circuits.

The scan driver 1530 may provide first scan signals SCAN1 (or gate writing signals), second scan signals SCAN2 (or gate compensation signals), third scan signals SCAN3 (or gate initialization signals), fourth scan signals SCAN4 (or gate bypass signals) and/or fifth scan signals SCAN5 (or gate drain signals) to the plurality of pixels PX in response to a scan control signal SCTRL received from the controller 1550. In some embodiments, the scan control signal SCTRL may include, but not limited to, a scan start signal and a scan clock signal. In some embodiments, the scan driver 1530 may sequentially provide the first scan signals SCAN1, the second scan signals SCAN2, the third scan signals SCAN3, the fourth scan signals SCAN4 and/or the fifth scan signals SCAN5 to the plurality of pixels PX on a row-by-row basis. In some embodiments, the scan driver 1530 may be integrated or formed in a peripheral portion of the display panel 1510. In other embodiments, the scan driver 1530 may be implemented with one or more integrated circuits.

The emission driver 1540 may provide emission signals EM to the plurality of pixels PX in response to an emission control signal EMCTRL received from the controller 1550. In some embodiments, the emission control signal EMCTRL may include, but not limited to, an emission start signal and an emission clock signal. In some embodiments, the emission driver 1540 may sequentially provide the emission signals EM to the plurality of pixels PX on a row-by-row basis. In some embodiments, the emission driver 1540 may be integrated or formed in the peripheral portion of the display panel 1510. In other embodiments, the emission driver 1540 may be implemented with one or more integrated circuits.

The controller 1550 (e.g., a timing controller (TCON)) may receive input image data IDAT and a control signal CTRL from an external host processor (e.g., an application processor (AP), a graphic processing unit (GPU) or a graphic card). In some embodiments, the control signal CTRL may include a mode signal representing whether a driving mode of the display panel 1510 is a normal mode in which the display panel 1510 is driven at a fixed frame frequency or a variable frequency mode in which the display panel 1510 is driven at a variable frame frequency. In some embodiments, the control signal CTRL may further include, but not limited to, a vertical synchronization signal, a horizontal synchronization signal, an input data enable signal, a master clock signal, etc. The controller 1550 may generate the output image data ODAT, the data control signal DCTRL, the scan control signal SCTRL and the emission control signal EMCTRL based on the input image data IDAT and the control signal CTRL. The controller 1550 may control an operation of the data driver 1520 by providing the output image data ODAT and the data control signal DCTRL to the data driver 1520, may control an operation of the scan driver 1530 by providing the scan control signal SCTRL to the scan driver 1530, and may control an operation of the emission driver 1540 by providing the emission control signal EMCTRL to the emission driver 1540.

In the normal mode, the host processor may provide the input image data IDAT to the controller 1550 at a fixed input frame frequency IFF, and the driving frequency DF of the display panel 1510 may be determined as the fixed input frame frequency IFF. Thus, the controller 1550 may control the data driver 1520 and the scan driver 1530 to drive the display panel 1510 at the fixed input frame frequency IFF, or at the fixed driving frequency DF.

In the variable frequency mode, the host processor may provide the input image data IDAT to the controller 1550 at a variable input frame frequency IFF by changing a time length (or a duration of time) of a blank period in each frame period, and the driving frequency DF of the display panel 1510 may be determined according to the variable input frame frequency IFF. Thus, the controller 1550 may control the data driver 1520 and the scan driver 1530 to drive the display panel 1510 according to the variable input frame frequency IFF, or at the variable driving frequency DF. For example, the variable frequency mode may be, but not limited to, a Free-Sync mode, a G-Sync mode, etc.

For example, as illustrated in FIG. 27, periods or frequencies of renderings 1610, 1620 and 1630 (rendering periods) by the host processor (e.g., the AP, the GPU or the graphic card) may vary (in particular, in a case where game image data are rendered), and the host processor may provide the input image data IDAT, or frame data FDAT1, FDAT2 and FDAT3 to the OLED display device 1500 in synchronization with the rendering periods 1610, 1620 and 1630 which are not uniform in the variable frequency mode. Thus, in the variable frequency mode, each frame period FP1, FP2 and FP3 may include active periods AP1, AP2 and AP3 having a same time length, but the host processor may provide the frame data FDAT1, FDAT2 and FDAT3 to the OLED display device 1500 at the variable input frame frequency IFF by changing the length (or the duration of time) of a variable blank period VBP1, VBP2 and VBP3 of each frame period FP1, FP2 and FP3.

In an example of FIG. 27, if a rendering period 1610 for second frame data FDAT2 is performed at a frequency of 120 Hz in a first frame period FP1, the host processor may provide first frame data FDAT1 to the OLED display device 1500 at the input frame frequency IFF of 120 Hz in the first frame period FP1. In the first frame period FP1, the controller 1550 may provide the first frame data FDAT1 to the data driver 1520 at the driving frequency DF of 120 Hz to drive the display panel 1510 at the driving frequency DF of 120 Hz. Further, the host processor may output the second frame data FDAT2 during an active period AP2 of a second frame period FP2, and may continue a vertical blank period VBP2 of the second frame period FP2 until a rendering period 1620 for third frame data FDAT3 is completed. Thus, in the second frame period FP2, if the rendering period 1620 for the third frame data FDAT3 is performed at a frequency of 60 Hz, the host processor may provide the second frame data FDAT2 to the OLED display device 1500 at the input frame frequency IFF of 60 Hz by increasing a time length of the variable blank period VBP2 of the second frame period FP2. In the second frame period FP2, the controller 1550 may provide the second frame data FDAT2 to the data driver 1520 at the driving frequency DF of 60 Hz to drive the display panel 1510 at the driving frequency DF of 60 Hz. Further, in a third frame period FP3, if a rendering period 1630 for fourth frame data FDAT4 is performed again at a frequency of 120 Hz, the host processor may provide the third frame data FDAT3 to the OLED display device 1500 again at the input frame frequency IFF of 120 Hz.

As described above, the OLED display device 1500 supporting the variable frequency mode may prevent a tearing phenomenon caused by a frame frequency mismatch by displaying an image in synchronization with the variable input frame frequency IFF. Further, as described above, each pixel PX of the OLED display device 1500 according to embodiments may include not only a seventh transistor for diode initialization, but also an eighth transistor for drain initialization. Accordingly, the pixel PX may be suitable not only for the normal mode but also for the variable frequency mode, and the OLED display device 1500 according to embodiments may display an image with a substantially uniform luminance not only in the normal mode but also in the variable frequency mode.

Figure 28:
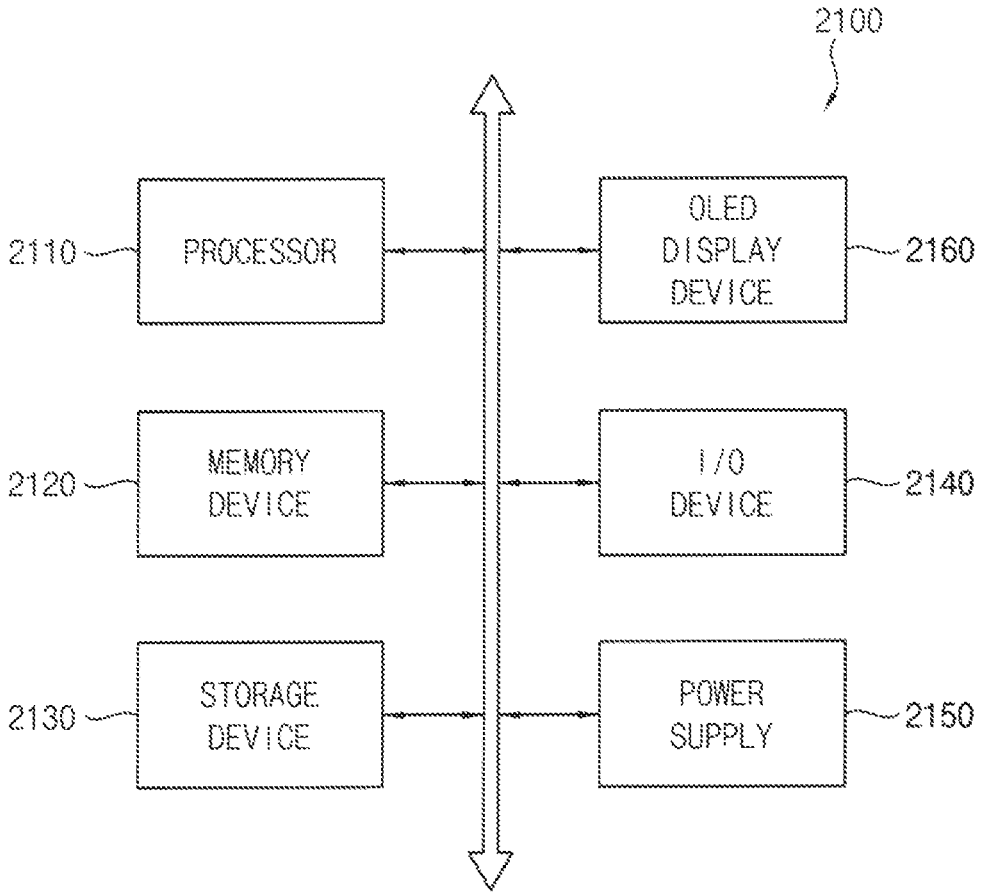
FIG. 28 is an electronic device including an OLED display device according to embodiments.

FIG. 28 is an electronic device including an OLED display device according to embodiments.

Referring to FIG. 28, an electronic device 2100 may include a processor 2110, a memory device 2120, a storage device 2130, an input/output (I/O) device 2140, a power supply 2150 and an OLED display device 2160. The electronic device 2100 may further include a plurality of ports for communicating with a video card, a sound card, a memory card, a universal serial bus (USB) device, other electric devices, etc.

The processor 2110 may perform various computing functions or tasks. The processor 2110 may be an application processor (AP), a micro processor, a central processing unit (CPU), etc. The processor 2110 may be coupled to other components via an address bus, a control bus, a data bus, etc. Further, in some embodiments, the processor 2110 may be further coupled to an extended bus such as a peripheral component interconnection (PCI) bus.

The memory device 2120 may store data for operations of the electronic device 2100. For example, the memory device 2120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 2130 may be a solid state drive (SSD) device, a hard disk drive (HDD) device, a CD-ROM device, etc. The I/O device 2140 may be an input device such as a keyboard, a keypad, a mouse, a touch screen, etc, and an output device such as a printer, a speaker, etc. The power supply 2150 may supply power for operations of the electronic device 2100. The OLED display device 2160 may be coupled to other components through the buses or other communication links.

In the OLED display device 2160, each pixel may include an eighth transistor for drain initialization. Accordingly, the pixel may be suitable not only for a normal mode but also for a variable frequency mode, and the OLED display device 2160 according to embodiments may display an image with a substantially uniform luminance not only in the normal mode but also in the variable frequency mode.

The inventive concepts may be applied to any OLED display device 2160, and any electronic device 2100 including the OLED display device 2160. For example, the inventive concepts may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A pixel of an organic light emitting diode (OLED) display device, the pixel comprising:

a first capacitor coupled between a first power supply voltage line and a first node;

a second capacitor coupled between the first node and a second node;

a first transistor configured to generate a driving current based on a voltage of the second node;

a second transistor configured to transfer a data voltage to the first node in response to a first scan signal;

a third transistor configured to diode-connect the first transistor in response to a second scan signal;

a fourth transistor configured to transfer an initialization voltage to the second node in response to a third scan signal;

a fifth transistor configured to transfer a reference voltage to the first node in response to the second scan signal;

a sixth transistor configured to couple a drain of the first transistor and an anode of an organic light emitting diode in response to an emission signal;

a seventh transistor configured to transfer the initialization voltage to the anode of the organic light emitting diode in response to a fourth scan signal; and an eighth transistor configured to transfer the initialization voltage to the drain of the first transistor in response to a fifth scan signal, wherein the organic light emitting diode includes the anode and a cathode coupled to a second power supply voltage line, wherein the eighth transistor is not turned on in a normal mode in which a display panel is driven at a fixed frame frequency, and wherein the eighth transistor is turned on to initialize the drain of the first transistor in a variable frequency mode in which the display panel is driven at a variable frame frequency.

2. The pixel of claim 1, wherein the eighth transistor includes a gate receiving the fifth scan signal, a source coupled to the drain of the first transistor, and a drain coupled to an initialization voltage line.

3. The pixel of claim 1, wherein the seventh transistor is turned on to initialize the organic light emitting diode in the a normal mode, and wherein the seventh transistor is not turned on in the a variable frequency mode.

4. The pixel of claim 1, wherein each frame period in the normal mode includes a gate initialization period in which a gate of the first transistor is initialized, a threshold voltage compensation period in which a threshold voltage of the first transistor is compensated, a diode initialization period in which the organic light emitting diode is initialized, a data writing period in which the data voltage is applied to the first node, and an emission period in which the organic light emitting diode emits light, and wherein each frame period in the a variable frequency mode includes the gate initialization period, the threshold voltage compensation period, a drain initialization period in which the drain of the first transistor is initialized, the data writing period, and the emission period.

5. The pixel of claim 4, wherein, in the drain initialization period, the emission signal has an off level, the fifth scan signal has an on level, the first, second, third and fourth scan signals have the off level, and the eighth transistor is turned on to apply the initialization voltage to the drain of the first transistor.

6. The pixel of claim 4, wherein a time length of the threshold voltage compensation period is longer than a time length of the data writing period.

7. The pixel of claim 4, wherein the diode initialization period overlaps the gate initialization period or the threshold voltage compensation period.

8. The pixel of claim 4, wherein the drain initialization period is located between the data writing period and the emission period.

9. The pixel of claim 1, wherein the second, third, fourth and fifth transistors are dual transistors.

10. The pixel of claim 1, wherein a first portion of the first through eighth transistors is implemented with a p-type metal oxide semiconductor (PMOS) transistor, and wherein a second portion of the first through eighth transistors is implemented with an n-type metal oxide semiconductor (NMOS) transistor.

11. The pixel of claim 1, wherein the initialization voltage transferred by the fourth transistor is a first initialization voltage, the initialization voltage transferred by the seventh transistor is a second initialization voltage and the initialization voltage transferred by the eighth transistor is a third initialization voltage which are different from each other and are transferred through different initialization voltage lines.

12. The pixel of claim 1, wherein the initialization voltage transferred by the seventh transistor is a second initialization voltage and the initialization voltage transferred by the eighth transistor is a third initialization voltage which are different from each other and are transferred through different initialization voltage lines.

13. The pixel of claim 12, wherein the initialization voltage transferred by the fourth transistor is a same voltage as the initialization voltage transferred by the seventh transistor or the initialization voltage transferred by the eighth transistor.

14. The pixel of claim 1, wherein the initialization voltage transferred by the fourth transistor, the initialization voltage transferred by the seventh transistor and the initialization voltage transferred by the eighth transistor are different from each other and are transferred through different initialization voltage lines.

15. The pixel of claim 1, wherein a signal line transferring the fourth scan signal and a signal line transferring the fifth scan signal are electrically connected to each other.

16. An organic light emitting diode (OLED) display device comprising:

a display panel including a plurality of pixels;

a data driver configured to provide a data voltage to each of the plurality of pixels;

a scan driver configured to provide a gate writing signal, a gate initialization signal and a gate drain signal to each of the plurality of pixels;

an emission driver configured to provide an emission signal to each of the plurality of pixels; and a controller configured to control the data driver, the scan driver and the emission driver, wherein each of the plurality of pixels includes:

a first capacitor coupled between a first power supply voltage line and a first node;

a second capacitor coupled between the first node and a second node;

a driving transistor configured to generate a driving current based on a voltage of the second node;

a switching transistor configured to transfer the data voltage to the first node in response to the gate writing signal;

a gate initialization transistor configured to transfer a gate initialization voltage to the second node in response to the gate initialization signal;

an emission transistor configured to couple a drain of the driving transistor and an anode of an organic light emitting diode in response to the emission signal; and a drain initialization transistor configured to transfer a drain initialization voltage to the drain of the driving transistor in response to the gate drain signal, and wherein the organic light emitting diode includes the anode and a cathode coupled to a second power supply voltage line, wherein the drain initialization transistor is not turned on in a normal mode in which the display panel is driven at a fixed frame frequency, and wherein the drain initialization transistor is turned on to initialize the drain of the first transistor in a variable frequency mode in which the display panel is driven at a variable frame frequency.

17. A pixel of an organic light emitting diode (OLED) display device, the pixel comprising:

a first capacitor coupled between a first power supply voltage line and a first node;

a second capacitor coupled between the first node and a second node;

a first transistor coupled between the first power supply voltage line and a third node;

a second transistor coupled between a data line and the first node;

a third transistor coupled between the second node and the third node;

a fourth transistor coupled between the second node and an initialization voltage line;

a fifth transistor coupled between the first node and a reference voltage line;

a sixth transistor coupled between the third node and an anode of an organic light emitting diode;

a seventh transistor coupled between the initialization voltage line and the anode of the organic light emitting diode; and an eighth transistor coupled between the initialization voltage line and the third node, wherein the organic light emitting diode includes the anode and a cathode coupled to a second power supply voltage line, wherein the eighth transistor is not turned on in a normal mode in which a display panel is driven at a fixed frame frequency, and wherein the eighth transistor is turned on to initialize the drain of the first transistor in a variable frequency mode in which the display panel is driven at a variable frame frequency.

18. The pixel of claim 17, wherein a control electrode of the seventh transistor and a control electrode of the eighth transistor are coupled to different scan lines which are activated during different time periods, respectively.

19. The pixel of claim 17, wherein a control electrode of the seventh transistor and a control electrode of the eighth transistor are coupled to a same scan line.

* * * * *